US007540796B2

(12) United States Patent
Spears et al.

(10) Patent No.: US 7,540,796 B2
(45) **Date of Patent: *Jun. 2, 2009**

(54) INFLATABLE BUOYANCY DEVICE WITH WATER-DEPENDANT TRIGGERING MECHANISM

(76) Inventors: Fredrick Spears, 665 Ann St., Oceanside, CA (US) 92057; Manfred Bradley Olson, 665 Ann St., Oceanside, CA (US) 92057

( * ) Notice: Subject to any disclaimer, the term of this patent is extended or adjusted under 35 U.S.C. 154(b) by 0 days.

This patent is subject to a terminal disclaimer.

(21) Appl. No.: 11/763,449

(22) Filed: Jun. 15, 2007

(65) Prior Publication Data

US 2008/0311805 A1 Dec. 18, 2008

(51) Int. Cl.
*B63B 22/10* (2006.01)

(52) U.S. Cl. ..... 441/8

(58) Field of Classification Search ..... 441/8
See application file for complete search history.

(56) References Cited

U.S. PATENT DOCUMENTS 2,687,541 A * 8/1954 Bannister ..... 441/9
4,493,664 A * 1/1985 Dale ..... 441/7
5,073,136 A * 12/1991 DeWitt et al. ..... 441/7
6,036,559 A * 3/2000 Arnold et al. ..... 441/8
7,232,354 B2 * 6/2007 Olson et al. ..... 441/7

* cited by examiner

*Primary Examiner*—Jesus D Sotelo
(74) *Attorney, Agent, or Firm*—Eric Hanscom; Todd Langford

(57) ABSTRACT

This invention is directed toward a device which provides buoyancy to objects with negative buoyancy in water. The invention comprises a water-sensitive trigger which, when activated, causes a balloon to inflate, causing the object to float upon the surface where the user can then easily and safely retrieve it, through one of two mechanisms: first, a compressed gas is allowed to exit a canister and enter a balloon, second, one or more substances which, when mixed with water will produce bubbles are exposed to water and the balloon is filled with bubbles from the chemical reaction. There are a number of variable characteristics, including canister size and shape, trigger fuse length, balloon configuration, and housing material that allow a user tremendous flexibility in selecting a proper size of the invention for the user's intended purpose.

1 Claim, 21 Drawing Sheets

INFLATABLE BUOYANCY DEVICE WITH WATER-DEPENDANT TRIGGERING MECHANISM

CROSS REFERENCE TO RELATED APPLICATIONS

This application claims benefit of Utility patent application Ser. No. 11/447,410, now issued as U.S. Pat. No. 7,232,354, with a filing date of Jun. 6, 2006.

STATEMENT REGARDING FEDERALLY SPONSORED RESEARCH OR DEVELOPMENT

This invention was not federally sponsored.

BACKGROUND OF THE INVENTION

This invention is directed toward a device which provides buoyancy to objects with negative buoyancy in water. The invention comprises several embodiments of a basic idea: to have a water-sensitive trigger which, when activated, allows water to flood an enclosed container, which causes a balloon to inflate, thereby floating an object to the surface of a body of water. One embodiment has a water-soluble bobbin dissolve upon contact with water, thereby allowing a spring to pus a canister of compressed gas into a sharp syringe which punctures the canister and directs the compressed gas into a balloon, which expands, thereby causing the object to float upon the surface where the user can then easily and safely retrieve it. A second embodiment has a water-activated trigger open a closed container which has at least one substance in it which, when mixed with water, creates bubbles, which are directed into a balloon. There are a number of variable characteristics, including canister size, trigger fuse length, balloon configuration, and housing material that allow a user tremendous flexibility in selecting a proper size of the invention for the user's intended purpose. Other embodiments of the invention provide breathing air for underwater purposes, means of floating sunken objects with holds, such as boats, and means of keeping cars, boats, airplanes, etc. floating when they fall into water.

One of the major problems facing boaters is the fact that there are many important objects on a boat which sink if dropped into the water. Common examples include keys, sunglasses, windlass cranks, and ropes. Once an object such as these, or any other object with negative buoyancy in water, falls into water it will sink. In many cases, should the object be important, or, as in the case of keys to a boat's engine, essential to the safety of the excursion, the loss of an object will have catastrophic consequences.

Thus, there has existed for as long as humans have used boats on the water a need for a device which allows negatively buoyant objects to float on the water until the object can be retrieved.

The prior has several examples of attempts to resolve this problem. The most common is a plastic float which is usually attached to the negatively buoyant object by means of a keychain, such that if the object is dropped overboard the object will float. These floats, however, because they do not enlarge in size and volume with compressed air, must be large enough to float and object. Thus, as a practical matter they are limited to small objects such as keys; a plastic float large enough to keep a windless crank above water would have to be so large that it would be impractical to keep one attached to the windlass crank at all times.

Thus there has existed a long-felt need for a device which allows a user to attach a small, inexpensive, and lightweight device to a negatively buoyant object such that the object will not sink when it falls in water. The current invention provides just such a solution by having a device which provides buoyancy to objects with negative buoyancy in water. The invention comprises a water-sensitive trigger which, when activated, causes a compressed gas to exit a canister and enter a balloon, which expands, thereby causing the object to float upon the surface where the user can then easily and safely retrieve it. There are a number of variable characteristics, including canister size, trigger fuse length, balloon configuration, and housing material that allow a user tremendous flexibility in selecting a proper size of the invention for the user's intended purpose.

Another common problem relating to water occurs when a car, truck, airplane, helicopter, train, or boat fills with water and sinks. Recovering sunken objects such as these is extremely difficult, as the object, in addition to its substantial weight in metal and other negatively buoyant materials, has the additional weight of the water which fills each compartment, or hold, of the object. The main method by which sunken objects such as these are recovered is to attach a strong line to the sunken object, then try to lift the object back to the surface of whatever ocean, river, or lake it sunk into.

Thus, there has also existed a long-felt need for a device and method by which a large sunken object with holds can be brought back to the surface. The current invention provides such a solution by teaching an inflation device with a "long" fuse time and a tough balloon. One or more of the invention can be inserted into the sunken object's hold or holds, either by SCUBA divers, submersibles, or remote control roving vehicles, and the long fuse allows sufficient time for the invention to be inserted. When the water finally eats through the long fuse, triggering the release of compressed gas, or delaying the access time it takes for water to reach a substance or substances which when mixed with water produce bubbles, the balloon expands and fills the hold, pushing out water and replacing the neutrally buoyant water with positively buoyant gas. If enough of the inflation devices are placed in the holds, eventually enough water will be forced out of the object and enough uncompressed gas will be trapped by the balloons inside the sunken object such that the object begins to float up to the surface on its own.

Another embodiment of the invention calls for the invention to be manufactured such that it can be installed as part of the original manufacture in cars, trucks, helicopters, airplanes, trains, and boats, or retrofitted into existing objects, where the invention is located in all of the holds of a particular object. The purpose of the invention in this embodiment is to provide a means of filling the holds before the water can completely fill the holds, and expelling that water which has already entered, thereby preventing the object from sinking.

For example, in an airplane the inventions could be positioned on the bottom of the cargo holds. If an airplane has to perform an emergency landing on a body of water, some water may begin to seep through into the cargo hold. Upon reaching the triggering devices, the water will set off the inflation process in which large balloons will very quickly fill to capacity, taking up all available space in the cargo holds and expelling the water that is already there. This would keep the airplane afloat for at least enough time for the passengers to evacuate safely.

Another example would be boats with holds. Had the Titanic had one of the inventions in each hold, the five holds which were initially damaged by the iceberg would have quickly been filled with a balloon rather than water, thereby, possibly keeping the boat afloat and at the very least given the passengers enough time to disembark safely. The invention is equally applicable to smaller boats, such as 20'-30' sailboats, which have at least several holds that could be effectively turned into flotation chambers by the invention.

A final problem that has plagued many water sports enthusiasts is the basic fact that humans do not have gills. As such, when a human is kept underwater for longer than a couple of minutes, the human usually dies. In sports such as SCUBA diving, kayaking, and big wave surfing, such submersions happen occasionally. Another embodiment of the invention provides breathing air for underwater purposes. In this embodiment, the canister contains compressed air, suitable for breathing. The trigger can be depth-sensitive or pressure-sensitive such that the inflation mechanism is triggered when the user exceeds a certain depth or has enough water on top of him/her that the triggering mechanism actives the inflation mechanism at certain pressures. The trigger can also have a variable length of fuse such that if a user has been submerged for a certain period of time, the trigger mechanism is eaten through by the water and the balloon is inflated, thereby carrying the user to the surface of the water.

A further trigger mechanism involves a small sponge which is compressed against the interior wall of the canister by a lever arm of a latch. Rather than relying upon the pressure of an expanding balloon to open the end cap, this triggering mechanism relies up the natural tendency of a dry, compressed sponge to absorb water and expand. The canister, when used with a sponge trigger, requires one or more holes in the canister to allow water into the canister when the invention is submerged into water. As the sponge absorbs the water, it expands rapidly and substantially, pushing out on the lever arm that has compressed it against the interior wall of the canister. As the lever arm is forced away from the interior wall of the canister, a latch at the end of the lever arm is dislodged from a locking point on the end cap. The lever arm is the sole means by which the end cap remains fixed over the open end of the canister, so when the lever arm is dislodged, it releases the end cap. The end cap can be constructed with or without a coiled spring at its pivot point of attachment to the top of the canister, such that with a coiled spring the end cap pops open on its own; without the spring the end cap is merely released so that the expanding balloon can open the end cap as it expands.

The canister can be manufactured in one, two, or three pieces. There are advantages and disadvantages to each design. With a one-piece canister, there is less likelihood that the means of connection between the various parts will malfunction, but it will be more difficult to insert all the various pieces of the apparatus (plunger, spring, canister, syringe, etc.) in the correct order. With a multi-piece canister, it will be easier to assemble—as at least the canister and bobbin have to be replaced after every use—but there is some danger that the screw threads or whatever other means of attachment there exists between the various section of the canister will become corroded, jammed with debris, or suffer from some other problem or malfunction.

Looking specifically at the "one-piece" canister, that is, a canister that is one unit comprising a hollow cylinder with one solid end and one open end, where an end cap is hingably attached to the open end, there are other ways to design what is basically a container made from two parts. It is possible to design the canister such that rather than being a cylinder which is considerably longer than its diameter, with an open end into which the various components of the invention can be inserted, that the container (referring to the combination of the canister and the end cap), can be manufactured to achieve the exact same desired means—namely an enclosing container that springs open when a certain amount of water or water at a certain pressure infiltrates the canister—by omitting the end cap and producing a canister manufactured in two mating halves. In this configuration, the two canister halves would be connected at the bottom by a hinge, and at the top by the lever, such that once the sponge expanded, it would allow the two halves to separate. The separation could be accomplished by either allowing the balloon to fill with the compressed gas, thereby forcing the two halves apart as the balloon expanded, or by positioning a spring in between the two halves such that the two halves were under constant pressure to separate, and the lever releasing from the lock would allow the spring for forcibly move the two halves apart.

Canister shapes other then a simple cylinder are envisioned. Indeed, just about any shape that could be made from two mating portions could accomplish the same result as the basic cylinder referred to in the bulk of this application. For example, nautically themed containers such as stylized wheels, treasure chests or sails could be manufactured so that the device would fit in with the boat and lifestyle of the owner.

It is also possible to use substances other than compressed air to create the lift necessary to bring the device to which the invention is attached back to the surface. It is well known that there are a number of substances which together, or in combination with other substances, will produce bubbles when mixed with each other or with water. The invention also contemplates that the gas to fill the balloon could be generated by a single substance combined with water, or two or more substances combined with water. A further version of the invention provides a mechanism by which two or more substances which when combined with each other produce gas and the incoming water that percolates through the holes in the canister dissolves a bobbin in between the two or more substances, thereby allowing them to mix and produce bubbles.

The embodiments of the invention which use substances rather than compressed gas could be manufactured in all the various embodiments of the container configurations, including the cylindrical container in one or multiple parts connected to an end cap, or the container with two mating halves without an end cap.

SUMMARY OF THE INVENTION

It is a principal object of the invention to provide a mechanism by which a user of the invention can attach an inflatable buoyancy device with a water-triggering mechanism to an object, such as car keys, windlass cranks, or sunglass cases, which would normally sink into water, such that if the object was dropped into water, such as off a boat, the water would trigger the inflatable buoyancy device to inflate, thereby keeping the object at the surface of the water where it could be retrieved by the user.

It is another object of the invention that the inflation apparatus of the invention function with any compressed gas, including by not limited to air, carbon dioxide, helium, and nitrogen.

It is also an object of this invention that the inflatable unit can emit an alarm, sound (sonar pulse), Radio Frequency (RF) signals, audio signals, or other signals that could be tracked or traced by satellite or other means of tracking and tracing.

Another object of this invention is that the unit can, upon being triggered by immersion in water or any of the other possible triggering events, emit a light from a gas or laser (which is the excitement of a solid, liquid or gas) or be coated with a glow-in-the-dark substance which is activated upon triggering.

It is also an object of this invention that the unit can function to trigger responses from the dinoflagellates most commonly know as the organisms responsible for "Red Tides", such that the area surrounding the unit, upon triggering, becomes phosphorescent, thereby allowing the unit to be seen more easily or be detected by a sensor designed to detect dinoflagellate activity.

It is an additional object of the invention that the housing of the invention can be made from metal, plastic, wood, fiberglass, carbon fiber, treated paper, treated cardboard, rubber, resin, cement, and infused alloys.

It is a further object of the invention that the parts of the housing fit together using a wide variety of devices, including screw threads, snaps, zippers, Velcro®, glue, water-soluble glue and other water-soluble means of attachment, all types of materials that could be welded, slip fit attachments, compression and expansion fitted products, press fit, rivets, locking/interlocking, twist or turn-locking mechanisms, and vacuum forming devices.

It is also an object of this invention that the invention be manufactured in a wide range of sizes, with a wide range of inflation capacities, such a user can find an inflatable buoyancy device for virtually any item the user wishes to protect from sinking.

It is another object of the invention that the gas canisters which provide the flotation be readily exchangeable, such that a user can carry several backup canisters so that if the invention is used once, the user can exchange a full canister for the spent canister, thereby using the invention over and over again during one trip out over the water.

It is an additional object of the invention that the canisters can be manufactured with a wide variety of company logos and other advertising features such that they can be used for on-site promotional uses.

It is a further object of the invention that the fuse, or bobbin, portion of the invention can be manufactured with a wide variety of "fuse times", such that a user can select how long he/she wants to object to remain in the water before the inflation mechanism is triggered.

It is also an object of this invention that the invention be manufactured such that it either fit into a personal flotation device, or could be manufactured as part of a personal flotation device, so that when a user wearing such a PFD fell into the water, the inflation device would be triggered, thereby giving the user additional flotation.

It is another object of the invention that the trigger could be pressure-sensitive in addition to be water-sensitive, such that the inflation device would be triggered only when the user was in water at more than a certain pressure, such as a surfer who wiped out on a large wave being held under the water or a SCUBA diver who exceeded a certain depth.

It is an additional object of the invention that the triggering device could have a gradual reaction, such that it would release only enough compressed gas to raise a person to a certain depth without releasing all the compressed gas at once.

It is a further object of the invention that in a compressed air embodiment of the invention, the invention would additionally comprise a breathing apparatus whereby the user could breathe the air as it comes out of the canister, then exhale the spent air into a flotation device.

It is also an object of this invention that the invention, in an embodiment in which the trigger has an extremely long "fuse time", can be used to float cars, boats, airplanes, helicopters and other objects which normally sink, where a SCUBA diver, submarine, or remote control ocean rover can implant the device in a hold of the sunken object and when the invention is triggered, the canister releases compressed gas into a balloon which then fills the hold, causing the object to become positively buoyant, such that the object rises to the surface.

It is another object of the invention that the use of the invention to float sunken objects can be used with multiple inflation devices all triggered by the same "fuse", all placed in different holds, such that a very large and heavy object can be raised.

It is an additional object of the invention that such "hold-filling" embodiments can be installed in cars, trucks, boats, airplanes, helicopters, trains, and other transportation means which occasionally are lost in oceans, rivers, and lakes, such that once such an object falls into the water, the invention is triggered in one or more holds, thereby causing the normally negatively buoyant device to float, either permanently or at least long enough for the passengers to escape safely.

It is a further object of the invention that the balloon has a number of means of facilitating retrieval by the user, including an eye hook or other projection into which a gaff could be inserted.

It is also an object of this invention that an LED, Glowstick, or other illumination device be attached to the invention and triggered by immersion in water through the triggering apparatus, thereby providing a light source in addition to the flotation provided by the balloon.

It is another object of the invention that the illumination could operate off a small, waterproof battery which powers the illumination only upon water contact or upon the water triggering the inflation device.

It is an additional object of the invention that the illumination can flash, change colors, or otherwise attract attention through its appearance.

It is also an object of this invention that the invention may be built into mechanisms such as fishing rods, gaffs, nets, and other gear that may fall overboard and necessitate retrieval.

It is another object of the invention that a spring sealing diaphragm be included in its construction that controls activation due to pressure when submerged in liquid.

It is an additional object of the invention that the invention that it be fashioned to function as a marker or buoy when thrown overboard by utilizing a line and weight.

It is also an object of this invention that the invention have significant military applications, such as salvage, safety, and identification.

A further object of the invention is to facilitate the retrieval of important or vital items, such as black boxes on airliners, radios, life rafts, communication devices, survival kits and products, first aid kits, navigational devices, gps units, sextants, outboard motors, generators, anchors, tools and tool boxes, binoculars, monoculars, night vision devices, and flashlights.

An additional object of the invention is an embodiment which can be manually activated for use in marking locations with a buoyant balloon, either in the water or on land, such as where search and rescue operations use helium in the canister.

The invention has further application in the crabbing and fishing industries, where a canister could be designed to be remote activated and raise pots or traps or lines.

Another object of the invention is found in fishing, SCUBA, river kayaking, or surfing suits that are two layers thick, where the device, when activated, allows the compressed gas out of the canister to fill the space between the two layers, such that the suit becomes buoyant and helps the wearer retain heat due to the insulating properties of air.

A further object of the invention deals with hazardous material stored in containers, upon which the device could be attached so as to keep the containers of hazardous waste from becoming irretrievably lost should they be lost at sea or into a deep lake or river.

An additional object of the invention is to use the inflation device in a throwable personal flotation device which could be made small and compact, for easy throwing over a longer distance than would be possible with a traditionally lightweight and bulky PFD, but when it hit the water it would automatically inflate to provide buoyancy in man overboard situations.

Another object of the invention is to allow the invention to be built into a box which can shield and protect valuable documents, such as log books, black boxes in airplanes, etc.

Further objects of the invention include:

Providing a sponge/latch release mechanism whereby a sponge is compressed behind a lever arm which locks two parts of the invention together, such that when water invades the interior of the invention, the sponge expands causing the lever to move and unlock the two parts, thereby allowing the balloon to expand and fill with a gas.

Providing a container made of two mating portions such that rather than having an end cap release, allowing the balloon to expand, the two halves of the container hingeably release from one other and allow the balloon to expand.

Providing a container in a shape other than a basic cylinder, where the shapes can be, optionally, nautically themed.

Providing a means of producing a gas to fill the balloon, where the means of producing gas is a combination of one or more substances with either water or other substances, where the produced gas fills the balloon.

It is a final object of this invention that the invention be made of simple, easy to find, inexpensive components, such that it provides an economical means of ensuring that valuable items which fall into water are not lost.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE INVENTION

Figure 1A:
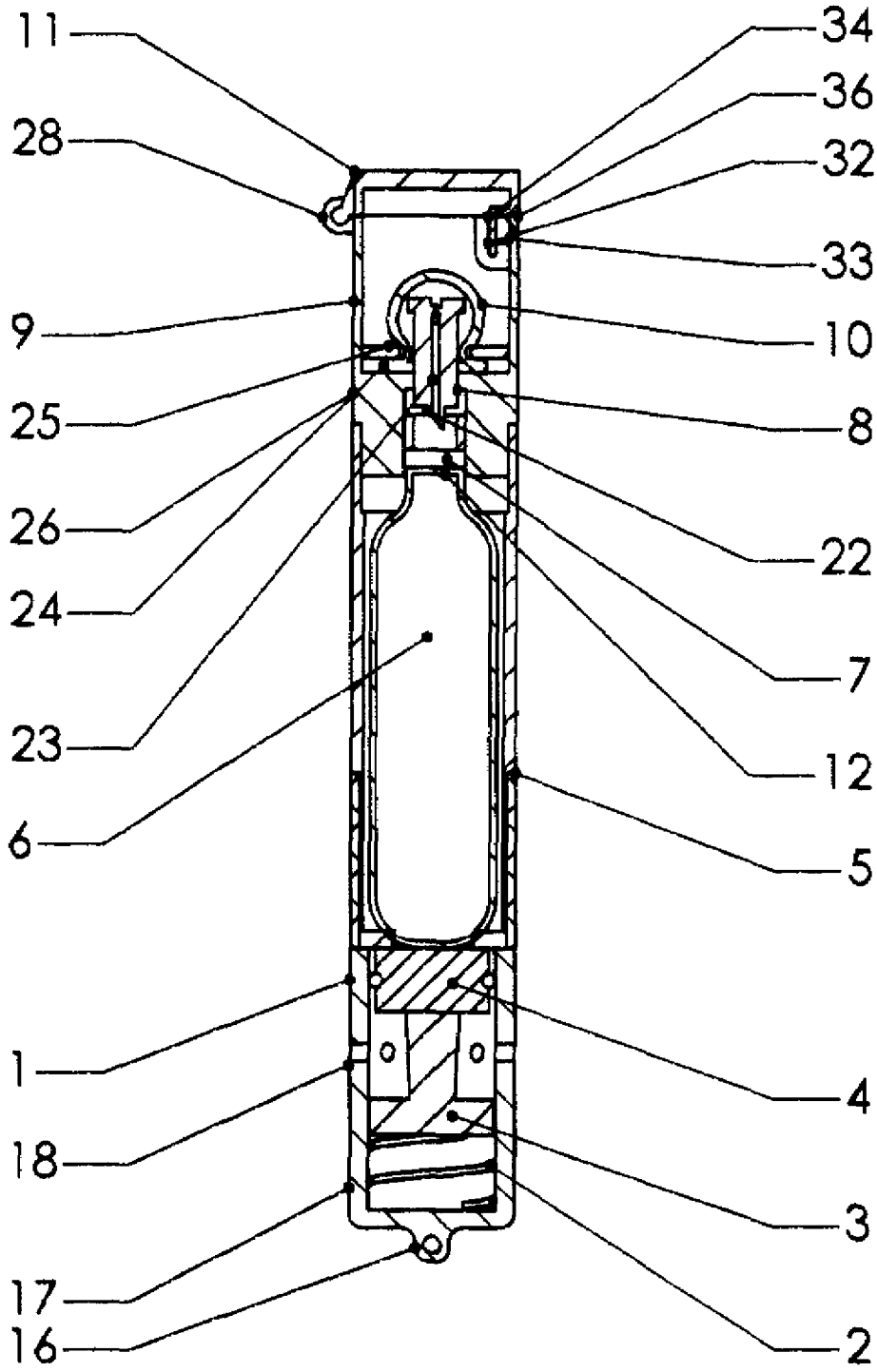
FIGS. 1A through 1D are a sequence of side, cross sectional views of one embodiment of the invention, showing the various parts of the invention. This embodiment has a cylindrical container and an end cap, where the end cap is released by a sponge/latch combination.

FIGS. 1A through 1D are a sequence of side, cross sectional views of one embodiment of the invention, showing the various parts of the invention. This embodiment has a cylindrical container and an end cap, where the end cap is released by a sponge/latch combination. The idea behind the invention is to provide a device which automatically punctures a compressed gas canister upon immersion in water, or upon a set time period of immersion in water or upon reaching a certain depth or water pressure, whereupon the compressed gas inflates a balloon or other inflatable device, causing the object to rise to the surface. Alternatively, in the case of retrieving an already sunken object, the device can be attached to the outside of the sunken object such that by inflating the device it adds external buoyancy to the sunken object to lift it to the surface, or, the device can be inserted into the inside of the sunken object such that it not only provides lift through buoyancy, but also displaces water already residing in the sunken object. For example, should a SCUBA diver drop a valuable anchor over the side of the boat, he/she could take a buoyancy device with a 5-minute activation "fuse", dive down the anchor in less than 5 minutes, attach the device to the anchor, and swim back to the surface to retrieve the anchor once the buoyancy device is activated.

Turning the FIG. 1, in this figure, there is a lower casing (1), with a bottom, into which a spring (2) fits, followed by a plunger (3) and a bobbin (4). The bobbin (4) is water soluble, such that once water enters the device and contacts the bobbin, the bobbin begins to disintegrate. The depth at which water may enter the device, and the rate at which the bobbin disintegrates upon contact with water are two factors that are adjusted for different embodiments of the invention depending on the desired result. The lower casing (1) attaches to a casing (5), which houses the canister (6) of compressed gas, preferably carbon dioxide but it is contemplated that a wide range of compresses gasses could be effectively used. On the other end of the canister (5), there is an O-Ring (7) and a syringe (8) which has at least one part, the puncture point (22), capable of puncturing the top of the canister. The bobbin (4) is the water-sensitive trigger: when the water eats through the bobbin, the spring (2) pushes the plunger (3) into the bottom of the canister (6), forcing the canister against the puncture point (22) of the syringe (8), which "pops" the canister, causing compressed gas to escape the canister, which is sealed against the syringe (8) by the O-Ring (7) and flow through a hollow tube (23) into a balloon (10), housed in a balloon casing (9). The end of the invention is an end cap (11), preferably of Mylar or some other material which is firm enough to retain a deflated balloon but which is easily pushed out by an expanding balloon. The lip (24) of the balloon (10) and anchored in place by brackets (25) which project inwardly from the interior surface of the balloon casing (9) and compress the lip (24). Once the balloon expands, the object to which the invention is attached floats to the surface.

The end cap (11) is attached to the balloon casing (9) by a hinge (28). The hinge (28) can, optionally, have a spring would around the point of connection such that the end cap is spring-loaded and will open upon release, or it can be manufactured without a spring, so that the end cap will open only upon the balloon expanding and forcing it open. To secure the end cap to the balloon casing until the invention has been submerged in water, a lever (34) is hingably attached to the inside of the balloon casing. Between the lever and the balloon casing is a sponge (35) which is compressed by the lever. At the top of the lever (32) is a latch (34) which secures the balloon casing to the end cap through the removably securing of the latch (34) to a lock point (36) on the end cap (11). When water rushes into the invention through inlets (shown here as 18 but it should be noted that inlets can be built into the device at other locations as well), the water begins to dissolve the bobbin (4), and is absorbed by a sponge (33) which is compressed under the lever (34). At the sponge expands, it moves the lever (32) away from the side of the balloon casing (9), removing the latch (34) from the lock point (36). Once the latch is removed from the lock point, the end cap (11) is free to rotate outward from the balloon (10). If the hinge (28) is spring-loaded, the end cap will snap open to allow the balloon (10) to expand; if the hinge is not spring-loaded, the expanding balloon will open the end cap and it expands outward from the balloon casing (9).

Figure 1B:
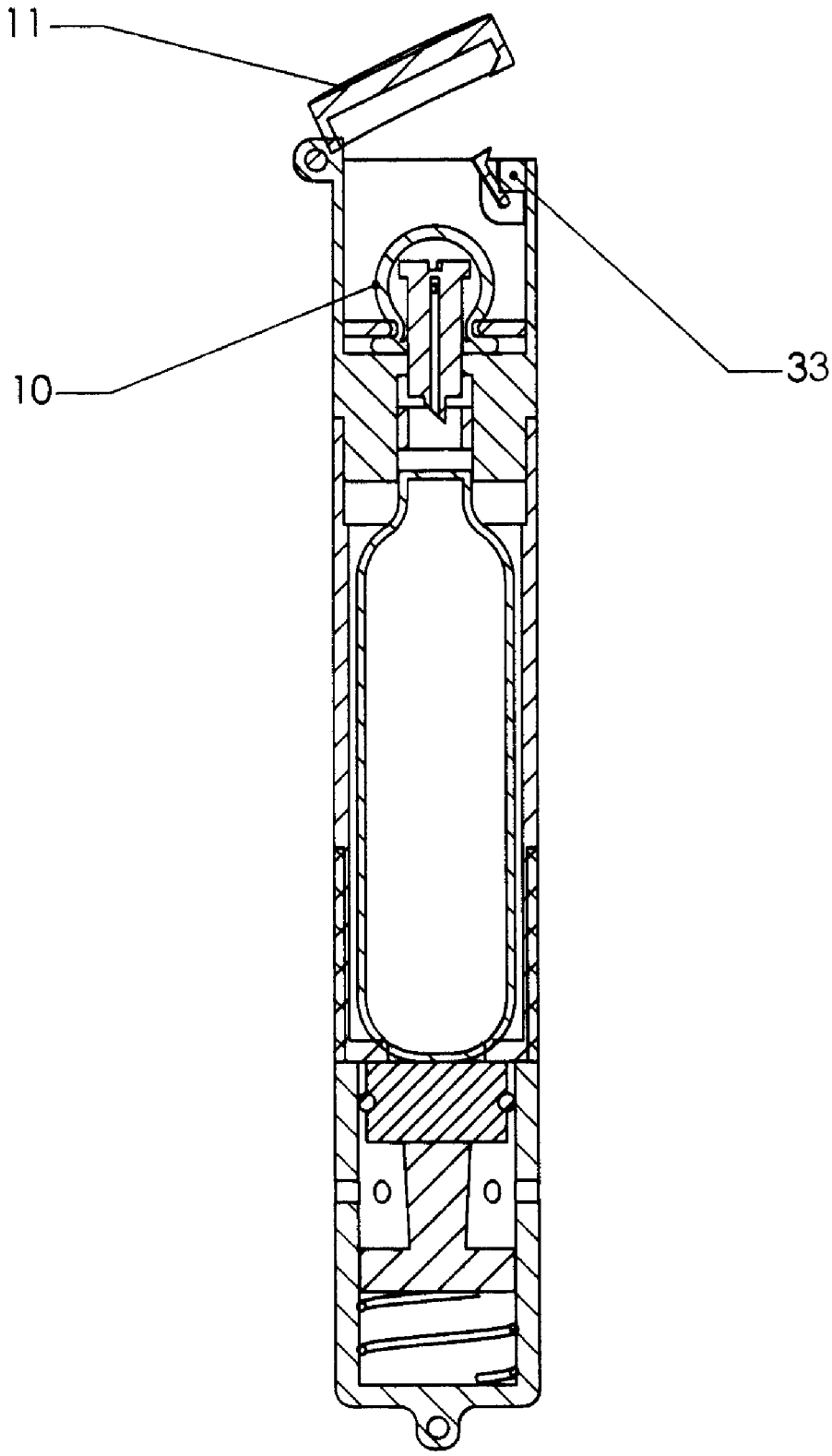

FIG. 1B shows the next sequential picture. The sponge has expanded, unlocking the end cap (11), which has now opened, ready for the balloon to expand.

Figure 1C:
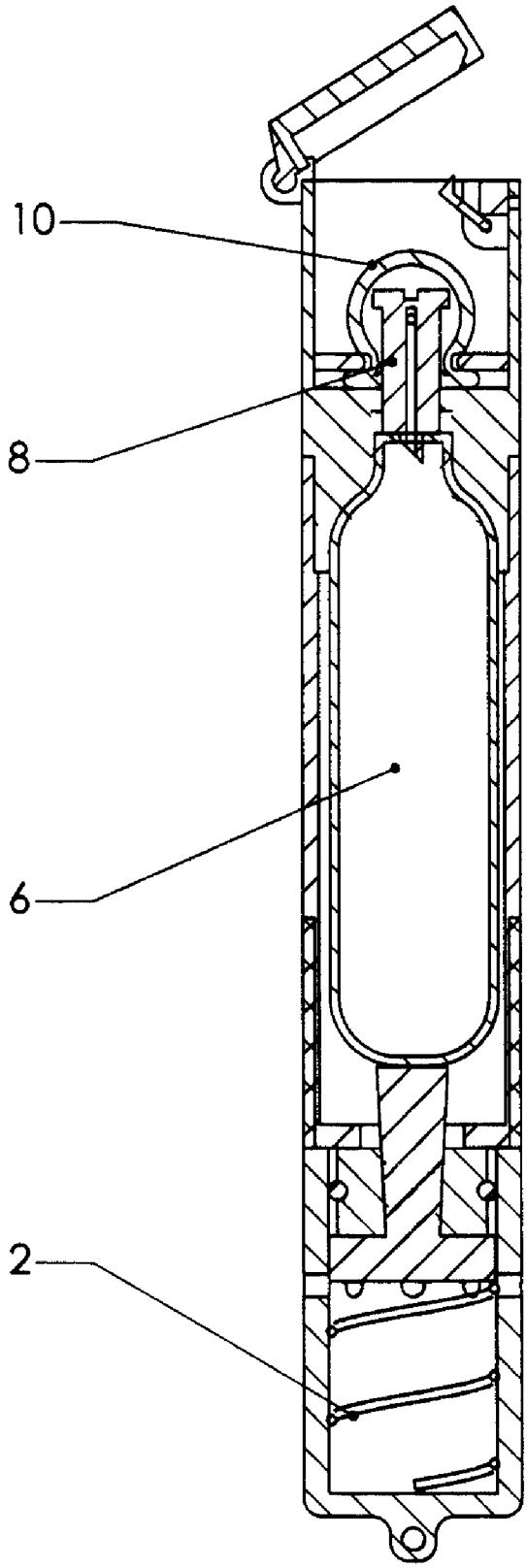

FIG. 1C is the next sequential picture. The end cap remains open, and the water has dissolved the bobbin, allowing the spring (2) to force the canister (6) into the syringe (8). The puncture point of the syringe has just punctured the canister, and the gas is about to flow from the canister into the balloon (10).

Figure 1D:
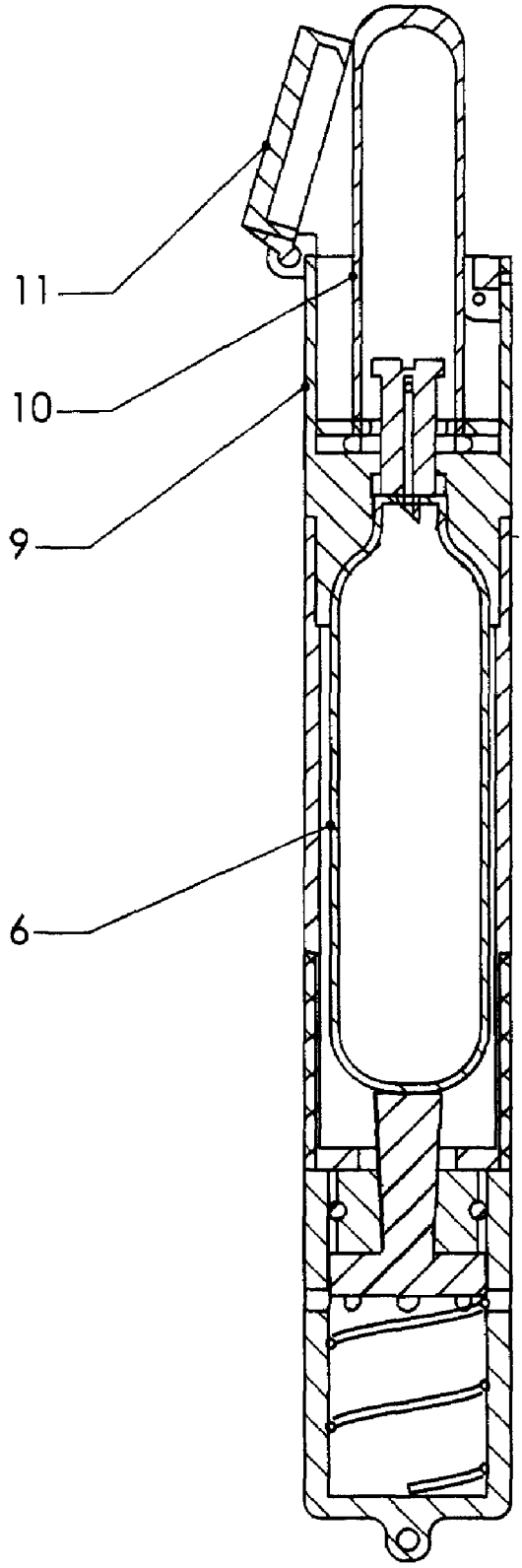

FIG. 1D is the final picture in this sequence. The compressed gas from the canister (6) is inflating the balloon (10). The expanding balloon (10) has forced the end cap (11) away from the opening to the balloon casing (9). As the balloon expands with the compressed gas, it will float the object to which the invention is connected back up to the surface.

Figure 2A:
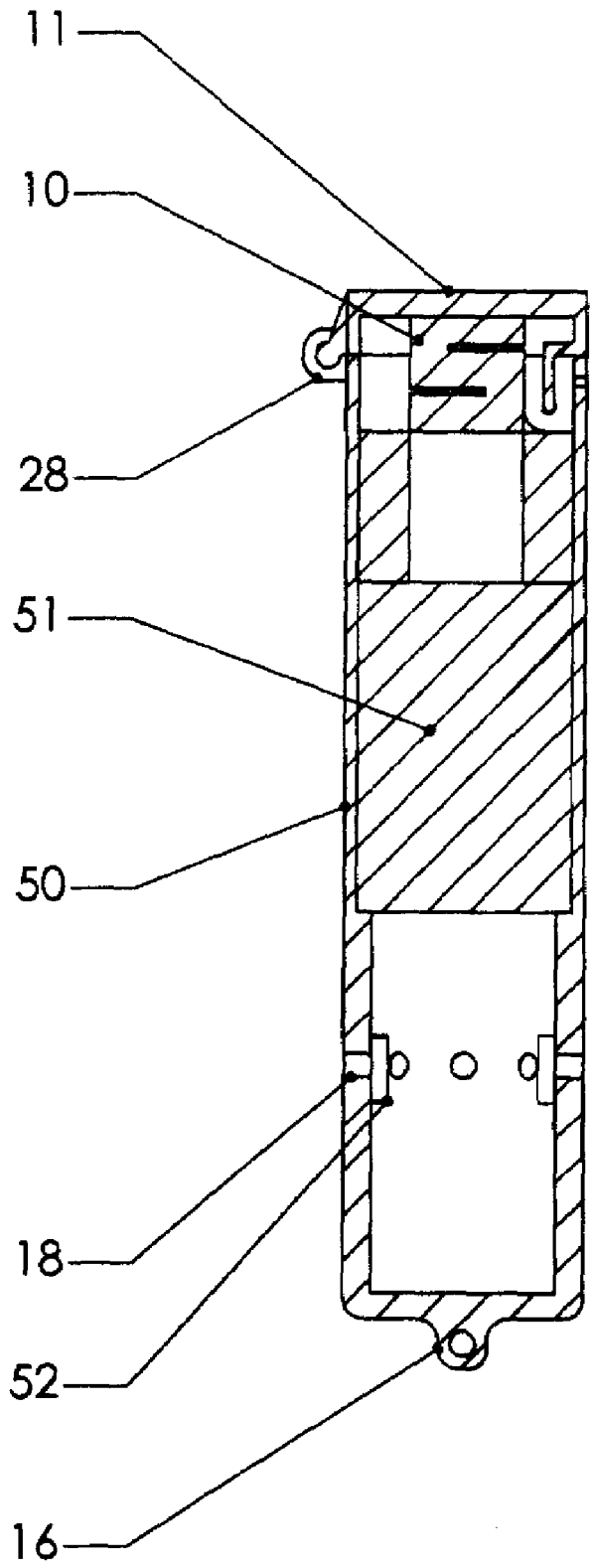
FIGS. 2A and 2B are a sequence of side, cross sectional views of an embodiment of the invention where there is a single substance which, when mixed with water, produces bubbles which then inflate the balloon.
Figure 2B:
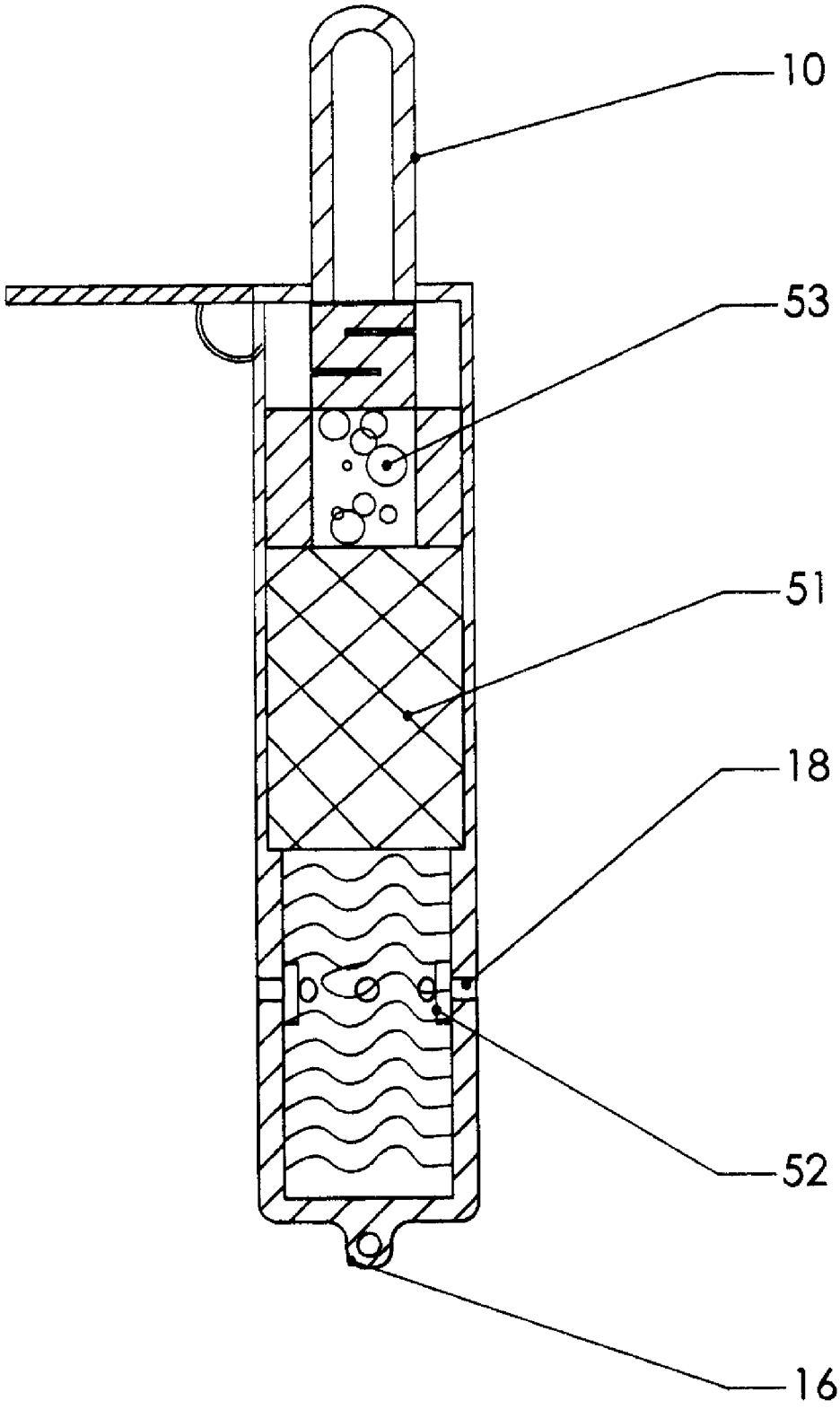

FIGS. 2A and 2B are a sequence of side, cross sectional views of an embodiment of the invention where there is a single substance which, when mixed with water, produces bubbles which then inflate the balloon. These figures show the container (50) comprising a single unit, rather than the 2-part and 3-part versions shown in other figures. It should be noted, however, that the number of components to the container is not meant to be limiting, as each of the 1-part, 2-part, 3-part, and containers with more than three parts can be used with either the compressed gas or the combination of substances with other substances or with water as a means to produce a gas which inflates the balloon and causes the object to which the invention is tethered to float to the surface. In FIG. 2A, the container (50) has a solid, dry block of a single substance (51) which, when mixed with water, produces bubbles. Sodium bicarbonate is a particularly preferred substance to use.

Turning to FIG. 2B, as the invention is submerged in water, such as when the object to which it is tethered falls into the water, water enters the inlets (18) which are holes in the side of the container (50). In this particular illustration, there are pressure-sensitive valves (52) on the inside of the container where the inlets (18) are located, which require a certain water pressure before water from the inlets (18) can enter the interior of the container (50). The purpose of the valves is to prevent a minor amount of water splashed onto the invention, such as would be generated by choppy seas or rain, from triggering the inflation of the balloon. The valves (52) are optional on all the containers described in this application, but can be applied to any of them. When a certain water pressure is exceed, water rushes into the container and comes into contact with the single substance (51) and the ensuing chemical reaction produces bubbles. Because the valves (52) are one-way valves, the bubbles cannot escape through the inlets (18), and so the bubbles fill the balloon (10). The end cap (11) can be either the Mylar cap described earlier, or the hingably attached cap shown here, where a lever/sponge combination unlocks the end cap upon the sponge coming into contact with water.

Figure 3:
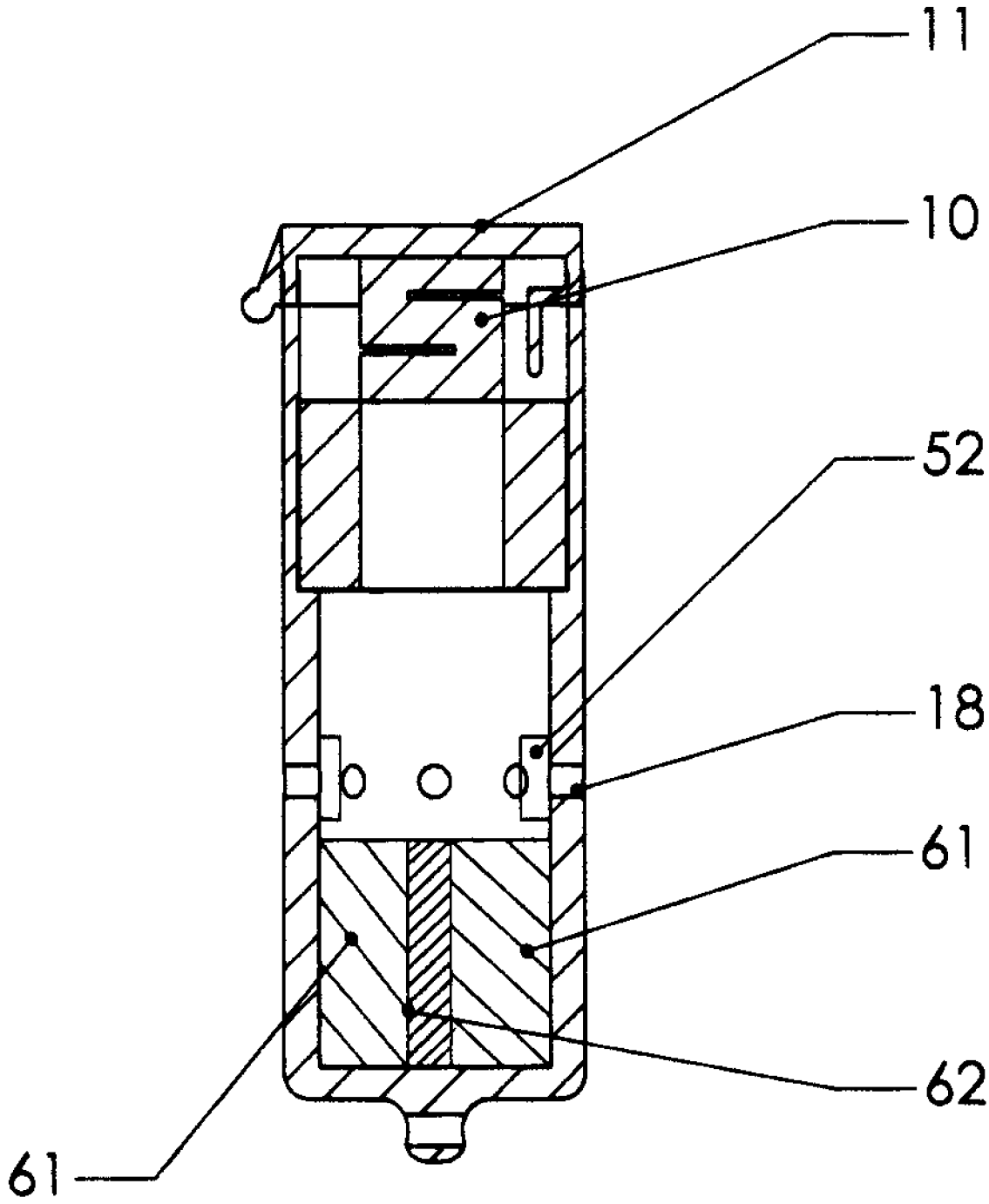
FIG. 3 is a side, cross-sectional view of another design of the invention, where two blocks of dry substances are located in the bottom of the container, where the two substances when combined with each other in a liquid form produce gas bubbles.

FIG. 3 is a side, cross-sectional view of another design of the invention, where two blocks of dry substances are located in the bottom of the container (50), where the two substances when combined with each other in a liquid form produce gas bubbles. This figure shows an outer, hollow cylindrical substance (61) enclosing a solid cylindrical block of another substance (62). It should be noted that more than two substances could be put into a container and perform a similar function. As water enters through the inlets (18), and passes the pressure-sensitive valves (52), it mixes with the two substances (61 and 62), turning both substances into a liquid form. The liquid form of the two substances then mixes, and the chemical reaction produces gas bubbles, which then fill the balloon (10). The end cap (11) can be either the Mylar version or the sponge/latch version.

Figure 4A:
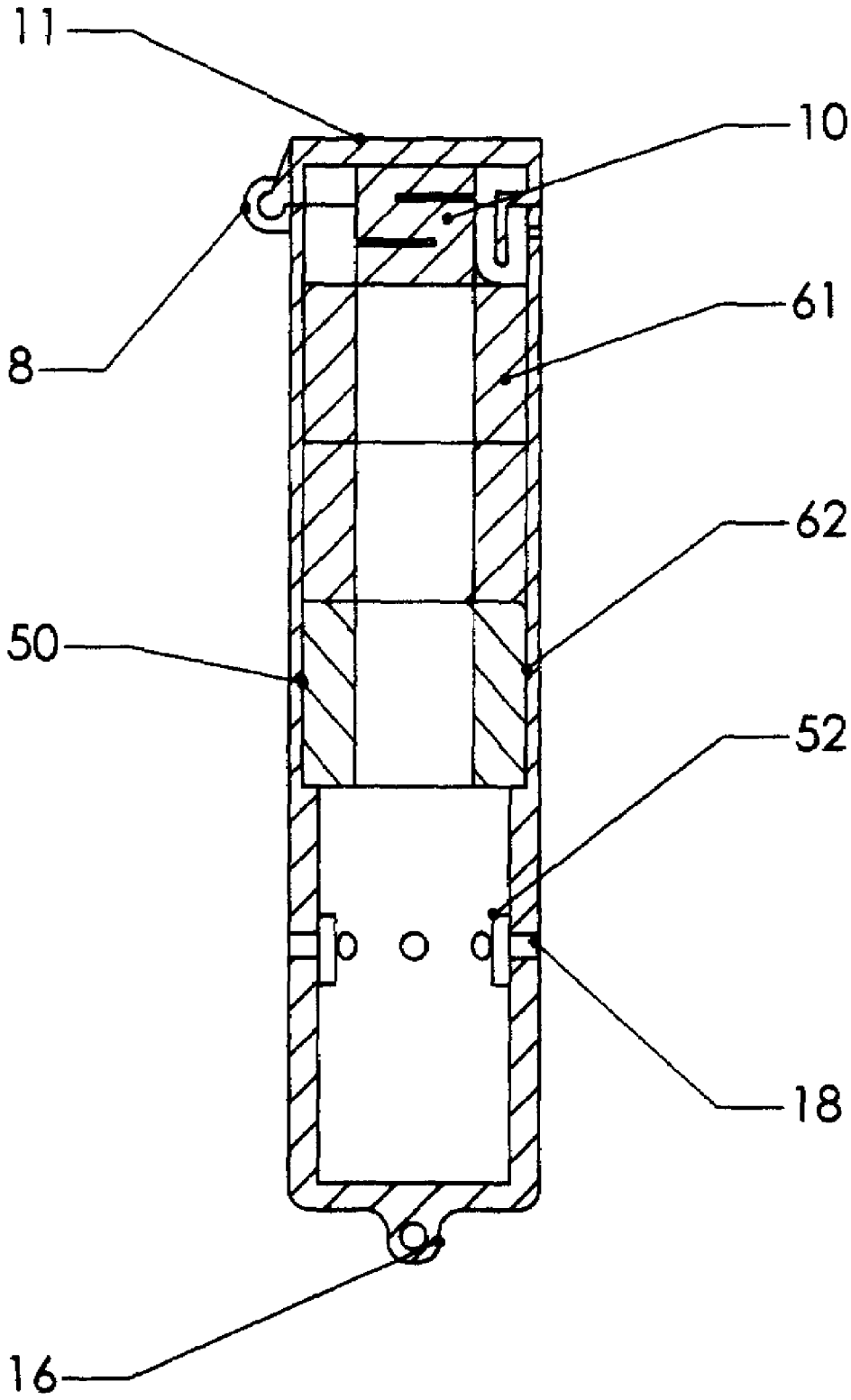
FIGS. 4A through 4D are side, cross-sectional views of yet another design utilizing two substances which, when mixed with each other in liquid form, or when mixed with water and each other in liquid form, produce bubbles.
Figure 4B:
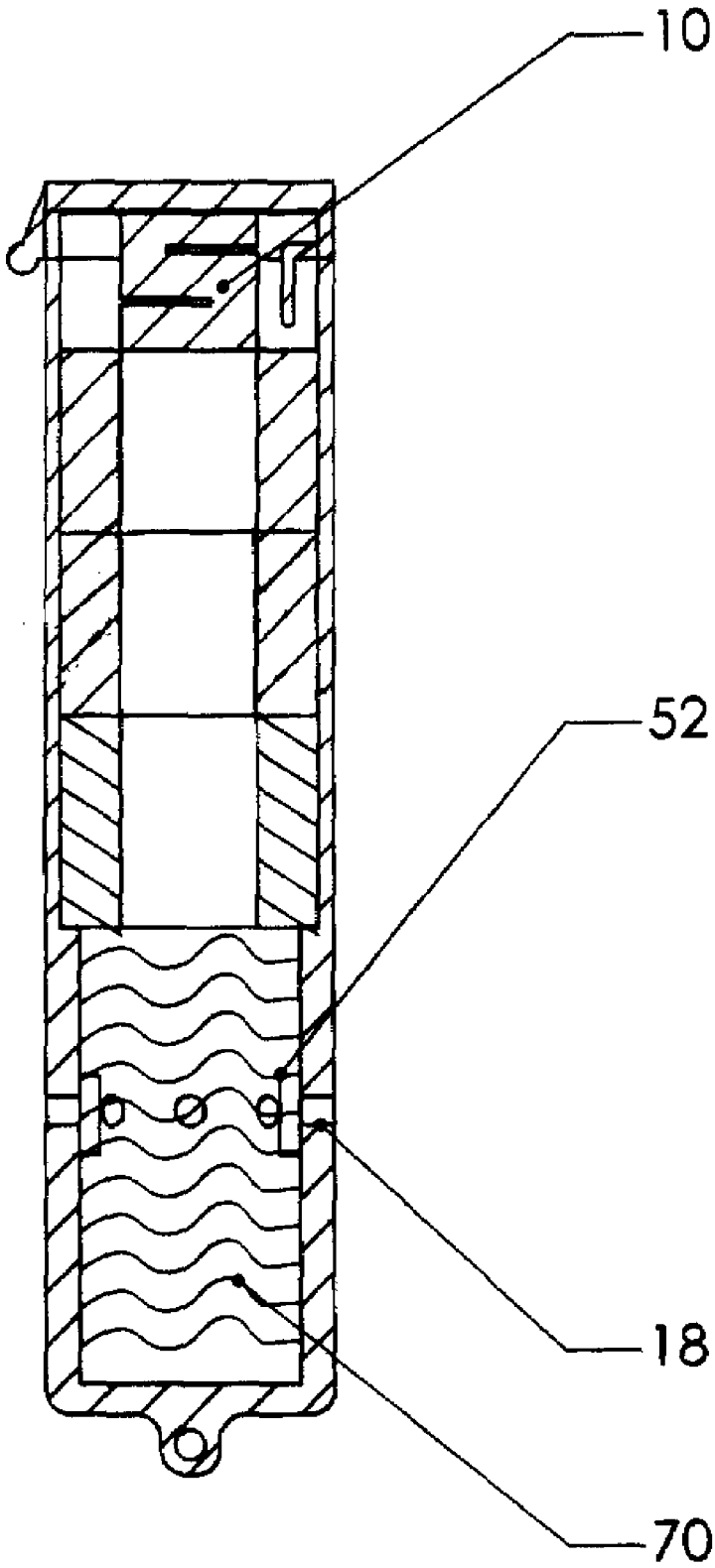
Figure 4C:
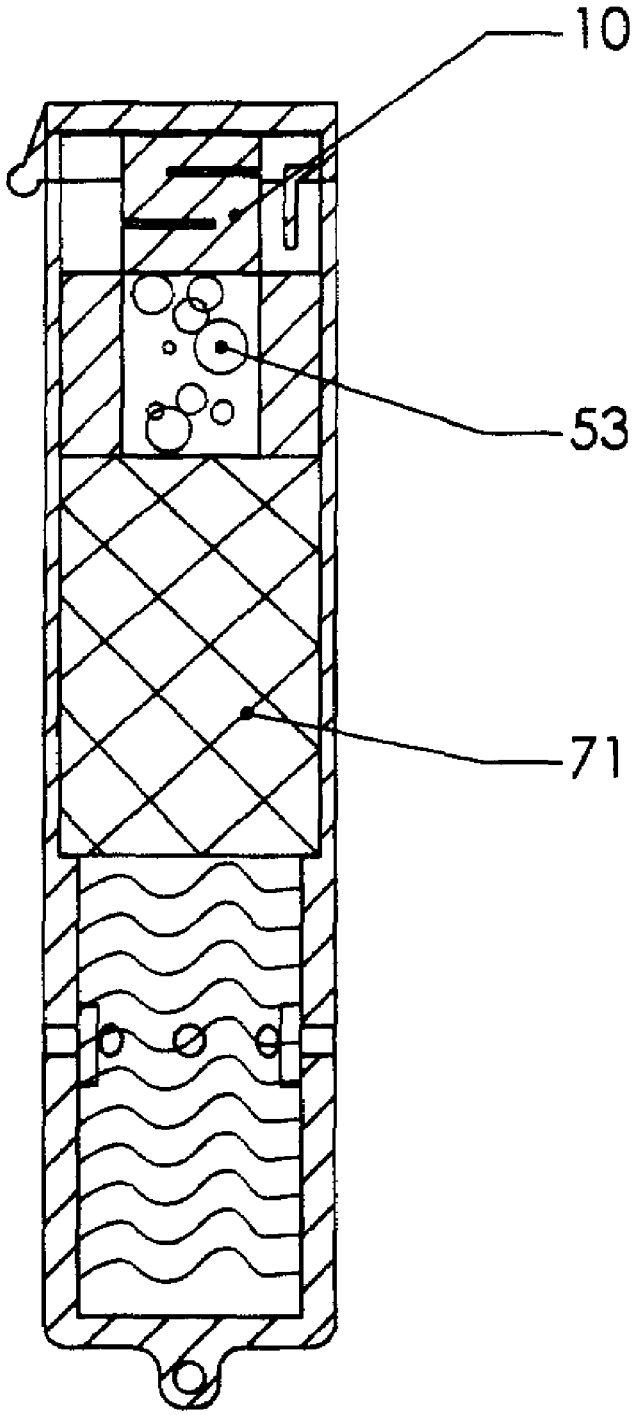
Figure 4D:
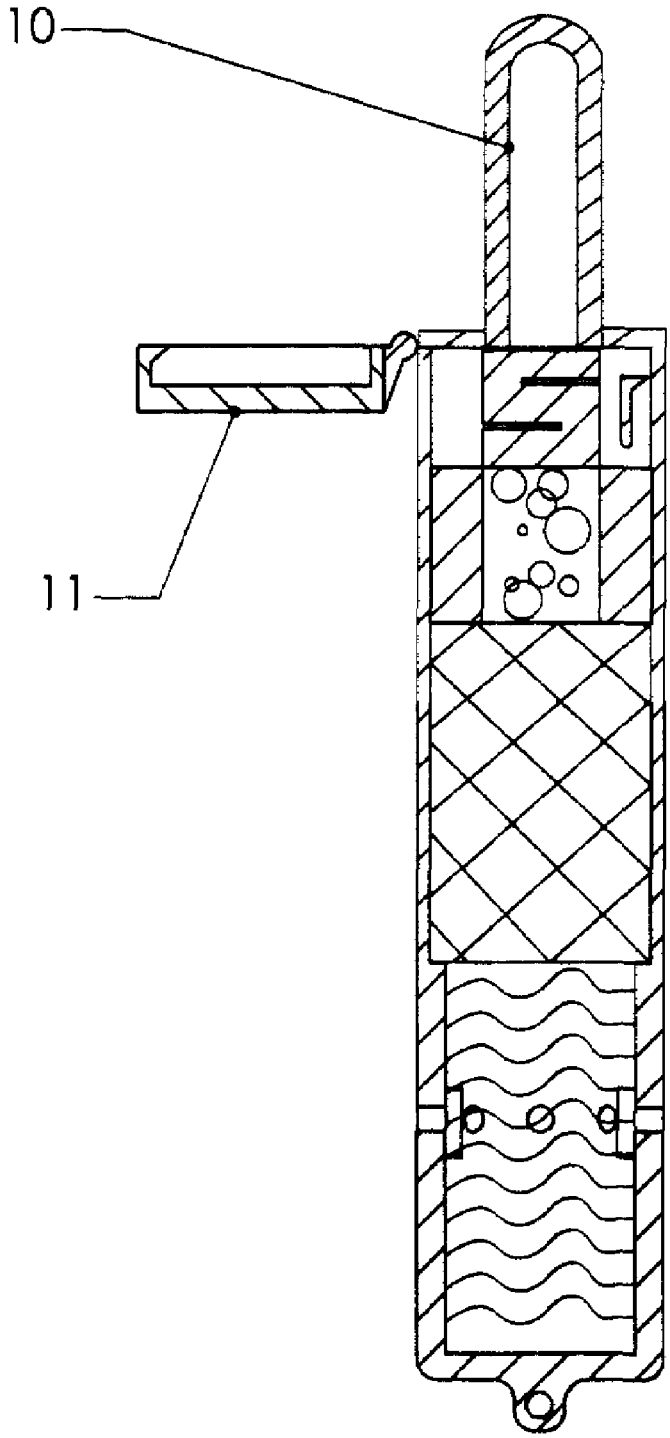

FIGS. 4A through 4D are side, cross-sectional views of yet another design utilizing two substances which, when mixed with each other in liquid form, or when mixed with water and each other in liquid form, produce bubbles. Turning to FIG. 4A, in this version, two hollow cylinders of dry, solid substances (61 and 62) and enclosed within a container (50). When the invention is submerged in water which produces a certain water pressure, as illustrated by FIG. 4B, water (70) pushes through the pressure sensitive valves (52) that block water from entering the inlets (18) at lower water pressures. FIG. 4C shows the two substances after they have been dissolved upon coming into contact with the water, and resulted in a dissolved mixture (71), which, in turn, creates bubbles (53) as a result of a chemical reaction between the two dissolved substances. FIG. 4D shows the balloon (10) which has been inflated by the bubbles, pushing the end cap (11) away, thereby allowing the balloon to expand and float the invention back to the surface of the water. It should be noted that the pressure sensitive valves (52) are preferably "one-way" valves, such that the bubbles cannot exit through the inlets (18)

Figure 5:
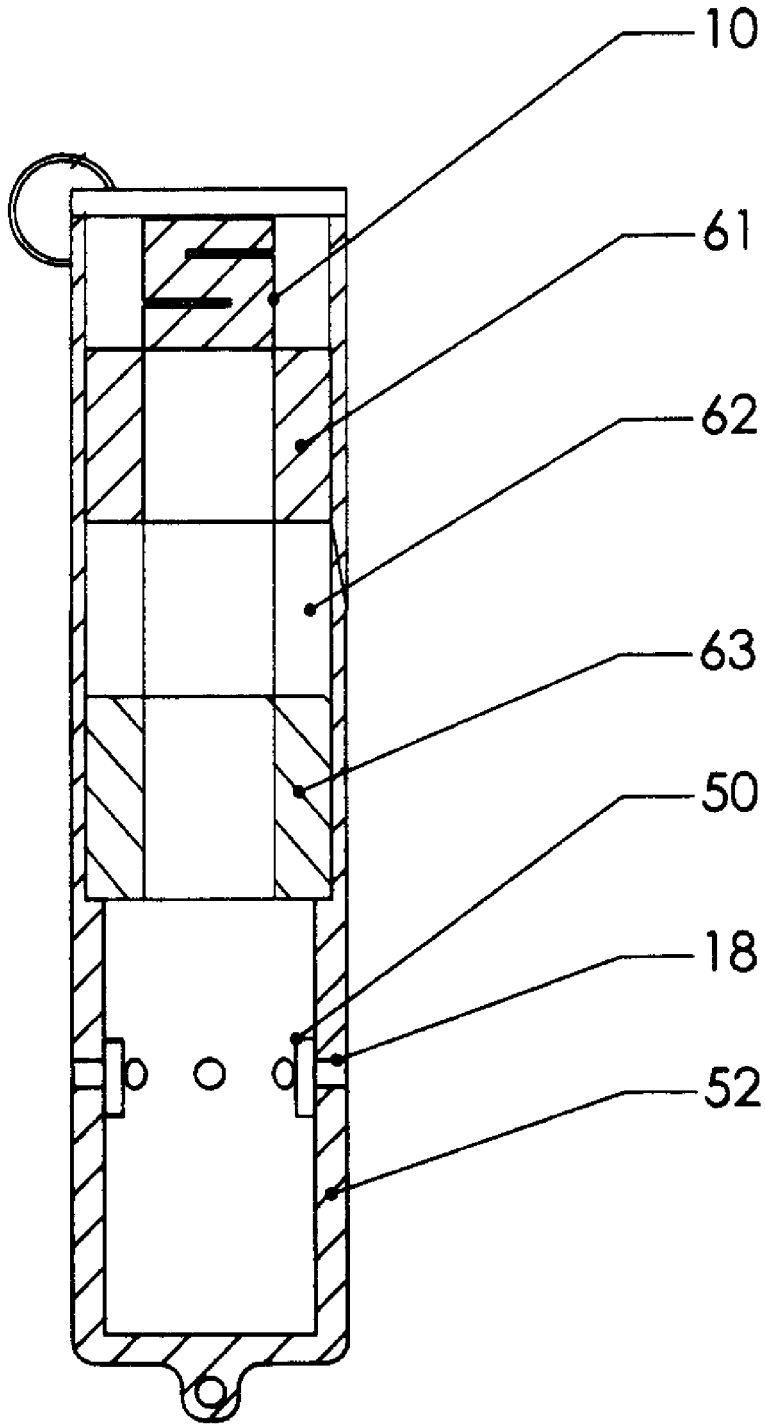
FIG. 5 is a side, cross-sectional view of yet another design utilizing substances which, when mixed with each other in liquid form, or when mixed with water and each other in liquid form, produce bubbles.

FIG. 5 is a side, cross-sectional view of yet another design utilizing substances which, when mixed with each other in liquid form, or when mixed with water and each other in liquid form, produce bubbles. In this design, three different dry substances (61, 62, and 63) are stacked as hollow cylinders one on top of the next, inside of the container (50). As water enters through the inlets (18) and passes the pressure-sensitive valves (52), it causes a chemical reaction between either the water and the three substances, or between the liquid forms of the three substances, resulting in the creation of bubbles, which then fill the balloon (10). It is envisioned that more than three substances could be used.

FIGS. 6A-6D are various views of an additional embodiment of the invention where instead of having an end cap and a canister, the invention has two half cylinders or mating container parts which are hinged at the bottom and "split apart" as the trigger is released. Other embodiments of this invention had a clear end cap section, which sat on top of a cylindrical section that held the compressed gas canister or substance which created bubbles when mixed with water and, optionally, other substances. FIGS. 6A-6D display another embodiment, where rather than having a relatively thin end cap on top of a cylinder, the cylinder is comprised of two mating halves which are hingably connected at one end, and have a trigger apparatus at the other end. When the trigger releases the two halves from each other, water rushes into the device and triggers either the dissolving of a bobbin or the mixing of one or more substances with water. In the case where a bobbin is dissolved in the "compressed gas canister" embodiment more fully described in U.S. patent application Ser. No. 11/447,410, which is incorporated herein by reference, a spring causes a sharp piece of metal to puncture a canister of compressed gas, which is then released into a balloon which blows up and floats the invention to the surface of a lake, river, or ocean. In the embodiment shown here, the device has a substance (either liquid or solid) which, when exposed to water (either fresh water or salt water), creates bubbles, where the bubbles then fill a balloon which floats the invention to the water's surface.

Figure 6A:
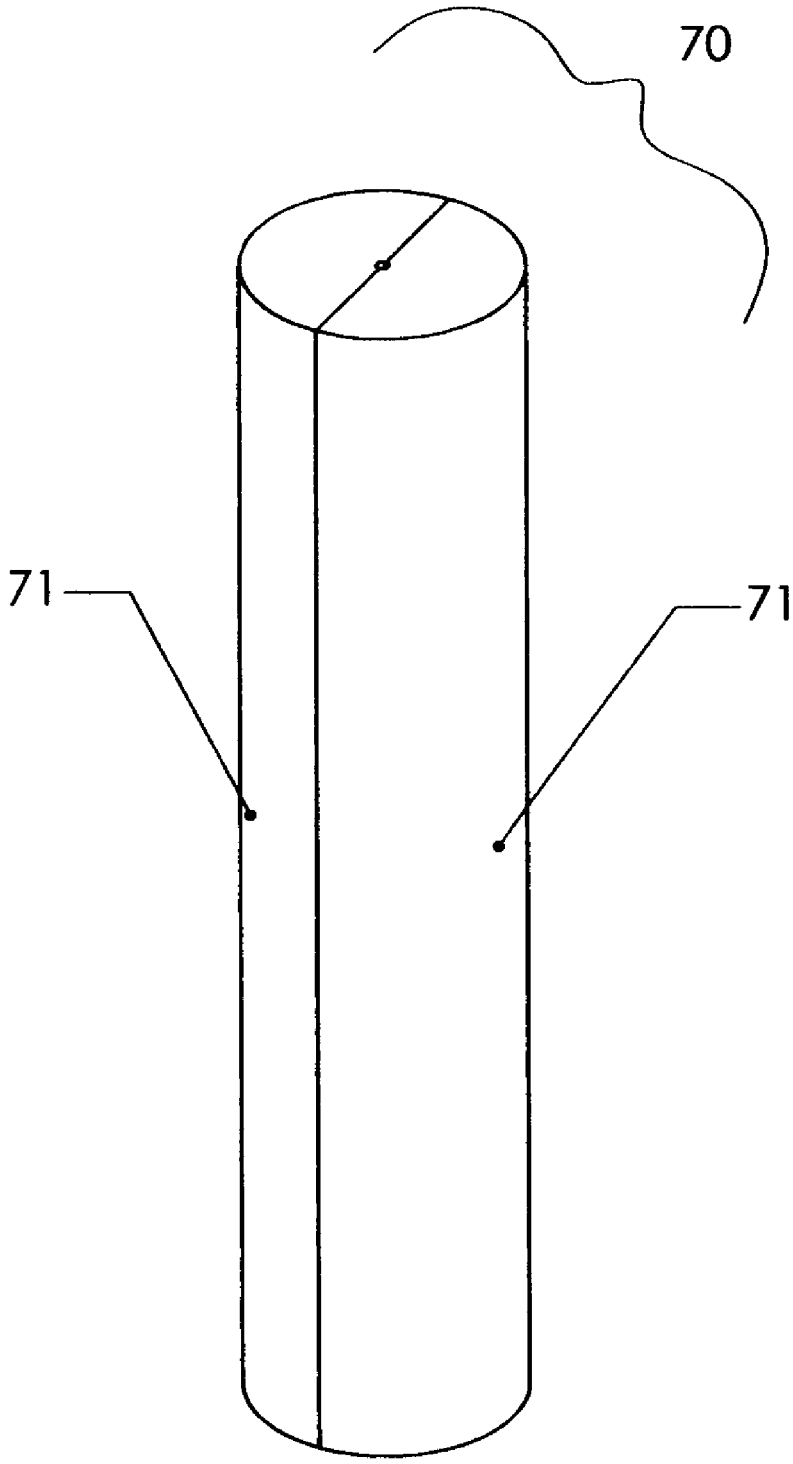
FIGS. 6A-6D are various views of an additional embodiment of the invention where instead of having an end cap and a canister, the invention has two half cylinders which are hinged at the bottom and "split apart" as the trigger is released.
Figure 6B:
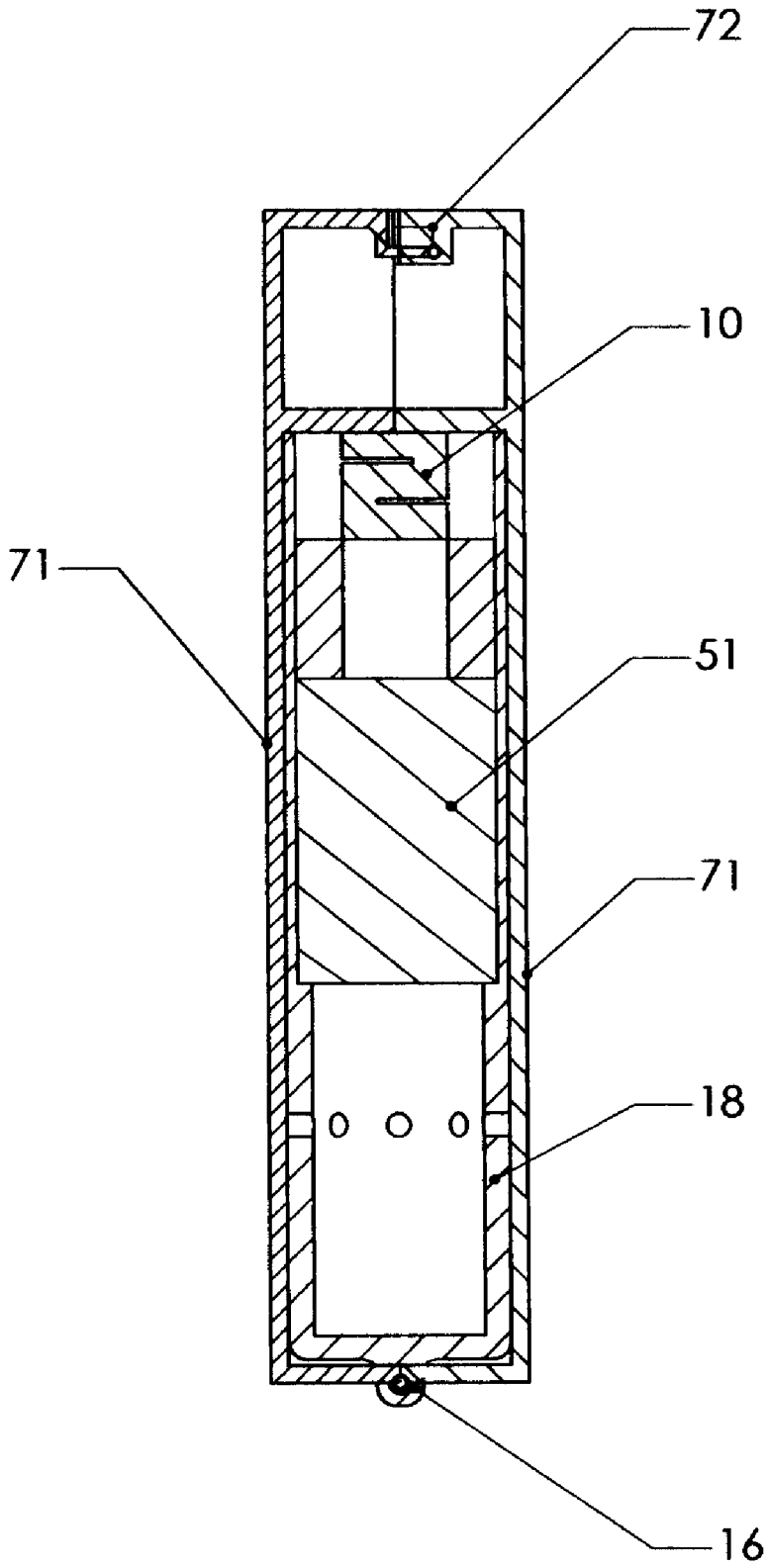
Figure 6C:
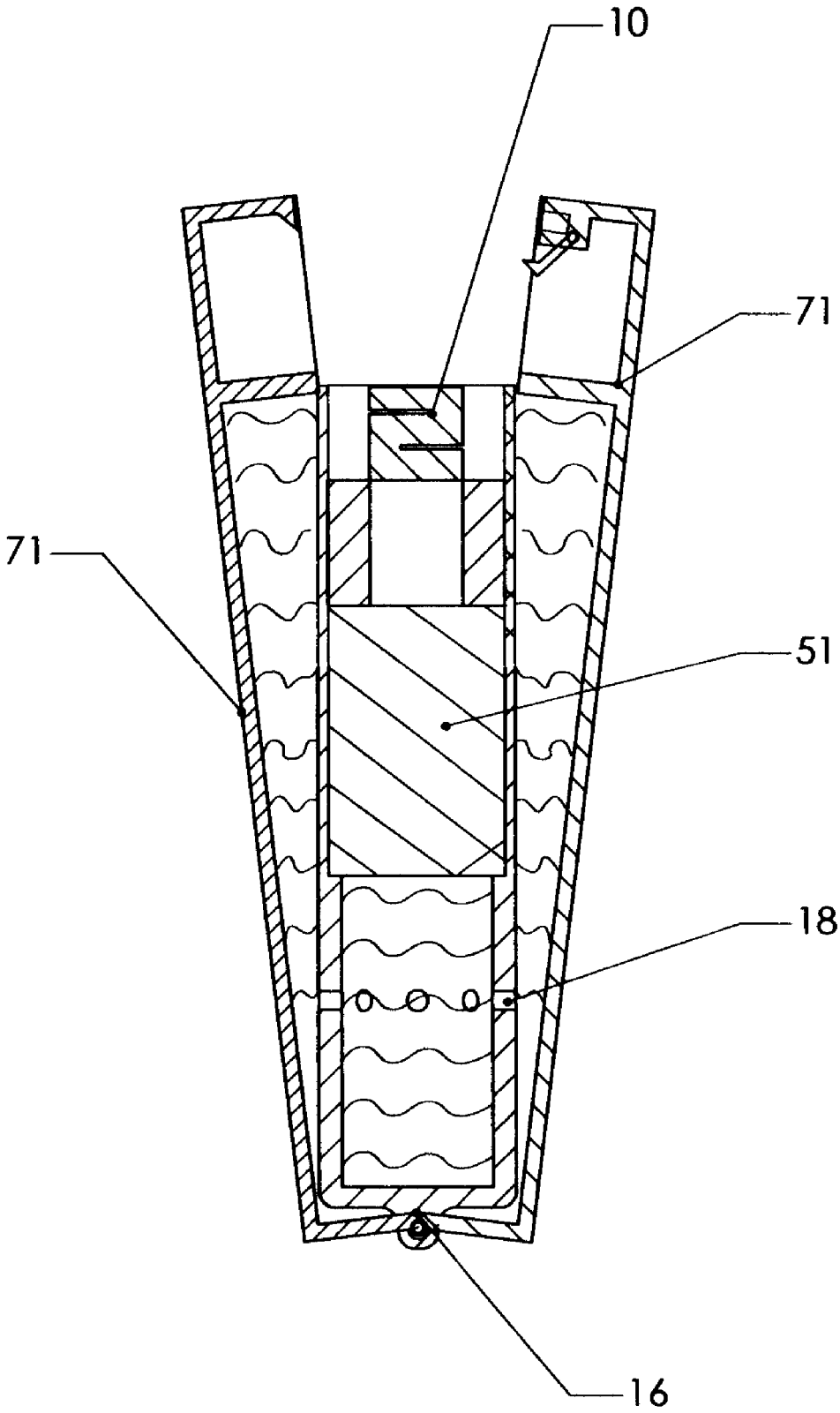
Figure 6D:
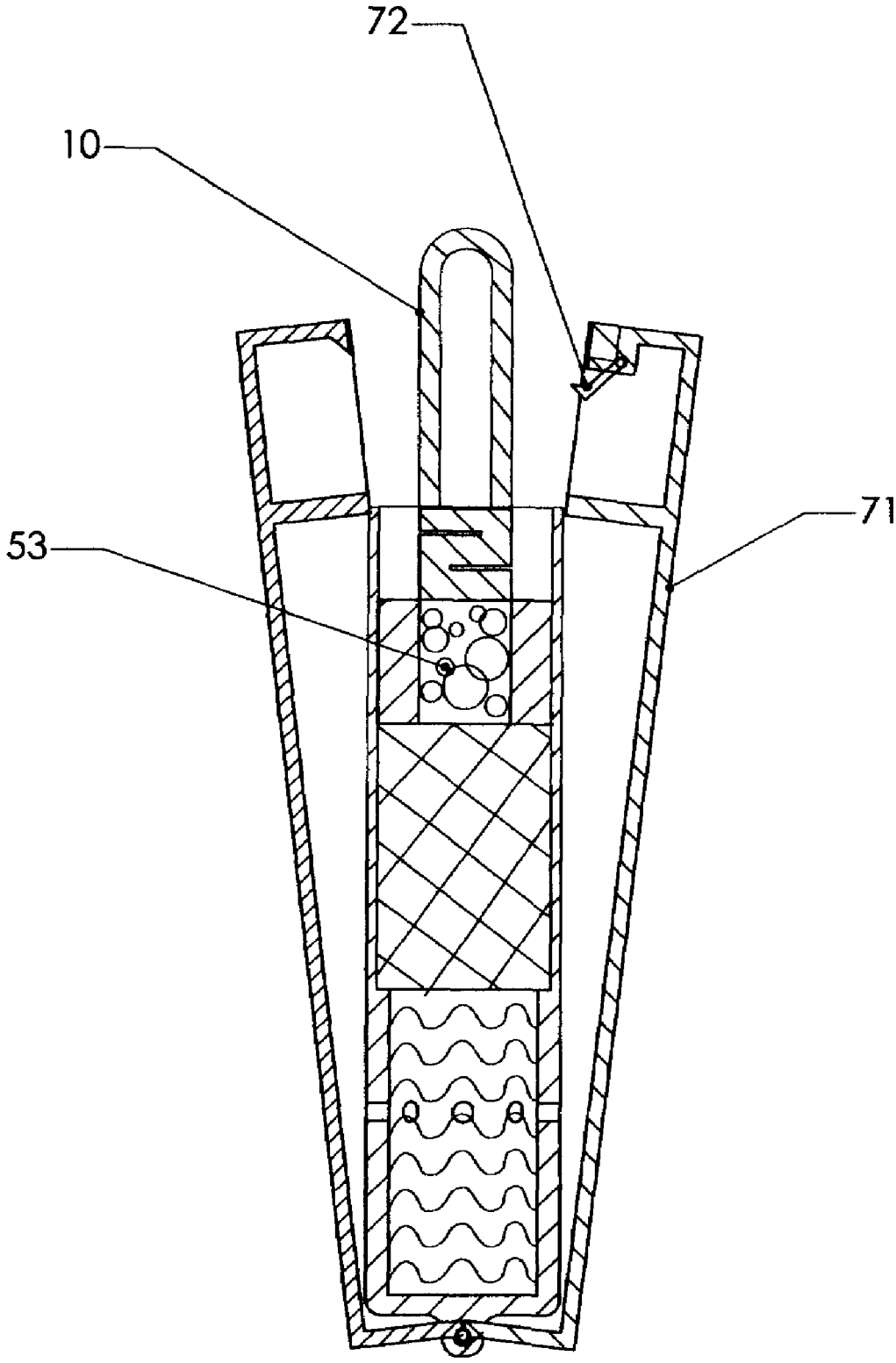

FIG. 6A is a perspective view of the invention in its most basic state: two mating container portions (71) of a cylinder, connected by a hinge on one end (the hinge is not shown in this figure). As can be seen, the basic difference with this embodiment is that there is no end cap, but rather two mating halves of a cylinder. FIG. 6B shows a cut-away view of the internal workings of the device before it falls into a body of water. The two mating halves (71) are connected by a hinge (16) at one end and a trigger device (generally referred to by reference number 72) at the other end. The trigger device can be any of the trigger devices discussed in this application or in patent application Ser. No. 11/447,410, and may, optionally, have inlets specifically directed at the trigger device. Inside the waterproof protection of the two mating container portions (71) are inlets (18) through which the water can rush once the two mating container portions (71) separate from each other to allow water to enter. There is also at least one substance, either in liquid or solid form, which, when mixed with water produces bubbles. Here, the illustration shows only one solid substance (51) but it is intended that other combinations of liquid and solid substances can be used. At the "trigger end" of the device is a balloon (10), which rests in its holding cavity until filled with bubbles. FIG. 6C shows the device immediately after it has been dropped into water. The water has caused the trigger device to release, and the two mating container portions (71) are separating. Water has rushed in through the ports (18) and has begun to mix with substance (51). FIG. 6D is the next in the sequence, showing that the water mixing with the substance has produced bubbles (53) that have inflated the balloon (10). As the balloon (10) expands, it causes the invention and the object to which the invention is attached to rise to the surface for easy retrieval.

Figure 7:
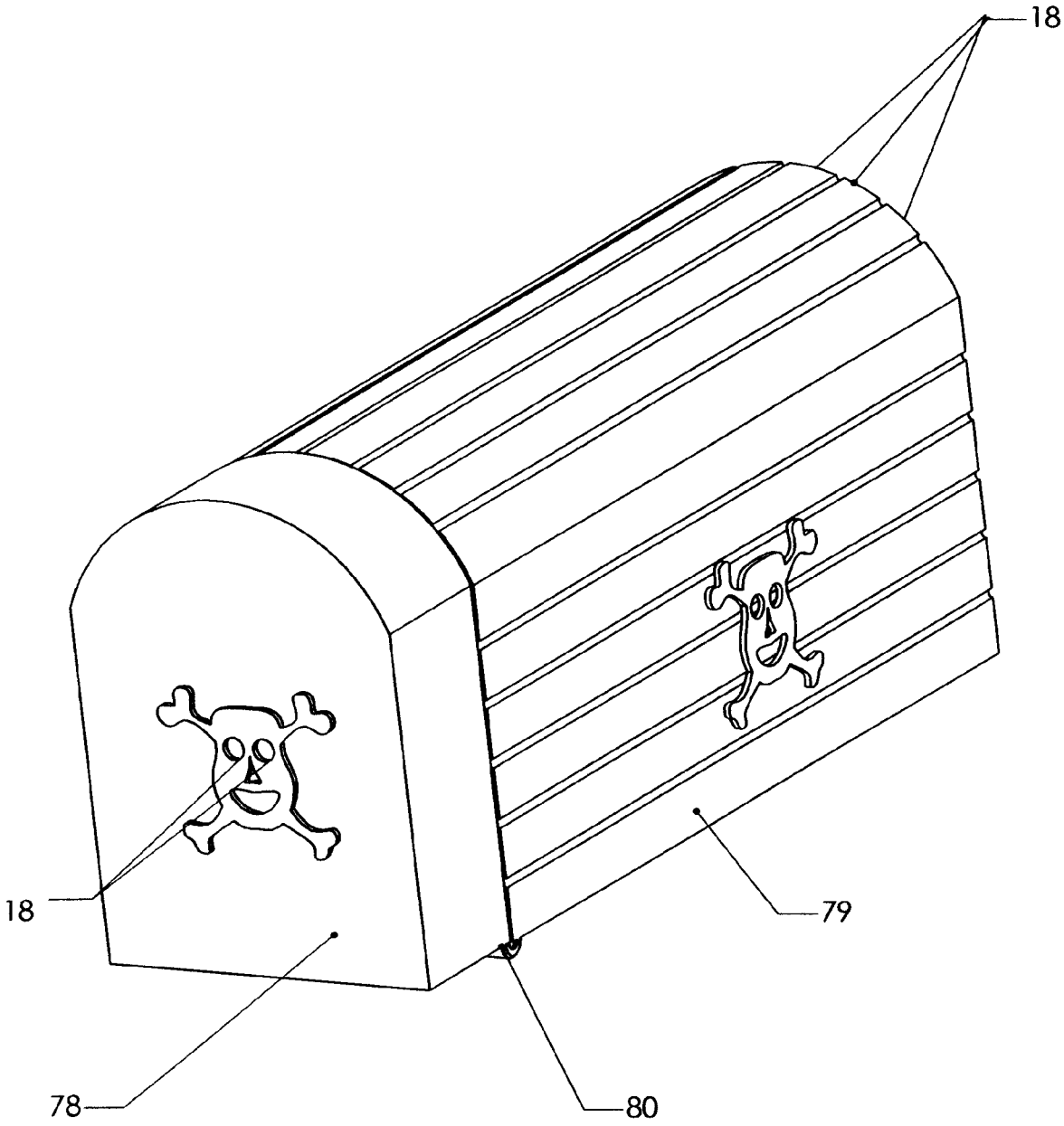
FIG. 7 is a perspective view of a fanciful and stylized versions of the invention described in FIGS. 2A-2B, showing how an embodiment with an end cap and container can be made to appear ornamental and stylish.

FIG. 7 is a perspective view of a fanciful and stylized versions of the invention described in FIGS. 2A-2B, showing how an embodiment with an end cap and container can be made to appear ornamental and stylish. FIG. 7 is a stylized embodiment of the invention designed to look like a pirate's treasure chest. It is envisioned that stylized embodiments like this one, particularly with nautical themes, would be popular items for attaching to keys and other lightweight objects. It has a main container (79), in which either a compressed gas canister/bobbin/syringe version or the version with one or more substances which when mixed with water produces bubbles is housed. This embodiment has an end cap (78) which is attached to the main container (79) by one or more hinges (80). There is a trigger mechanism inside, which can be any of the various trigger mechanisms described in this patent or in U.S. patent application Ser. No. 11/447,410. As water enters the main container (79) through inlets (18), which are located here as the eyes of the skull, but could just as conceivably be located anywhere on the device such that the triggering mechanism is coated with water once water penetrates the exterior of the device, the trigger mechanism is activated, releasing the end cap (78) from the main container (79) and allowing the balloon (not shown in this figure but contained within the main container 79) to expand and allow the invention to rise to the surface, along with the object to which it is tethered.

Figure 8A:
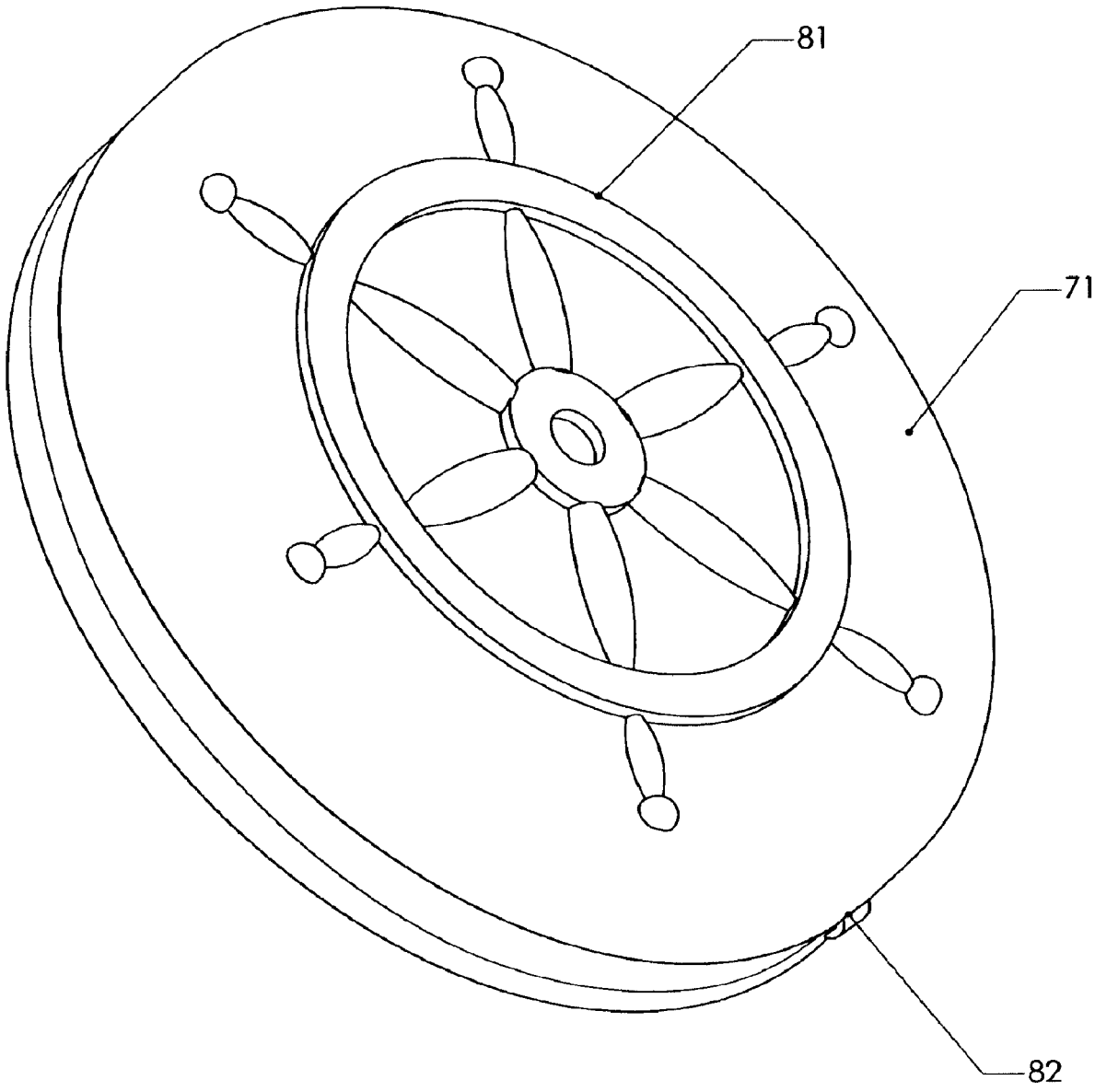
FIGS. 8A-8D are various views of how a stylish and ornamental version of the embodiment shown in FIGS. 6A-6D can work utilizing the compressed gas version of the invention. It should be noted that the substance version of the invention could work equally well in the ornamentally designed version shown here.
Figure 8B:
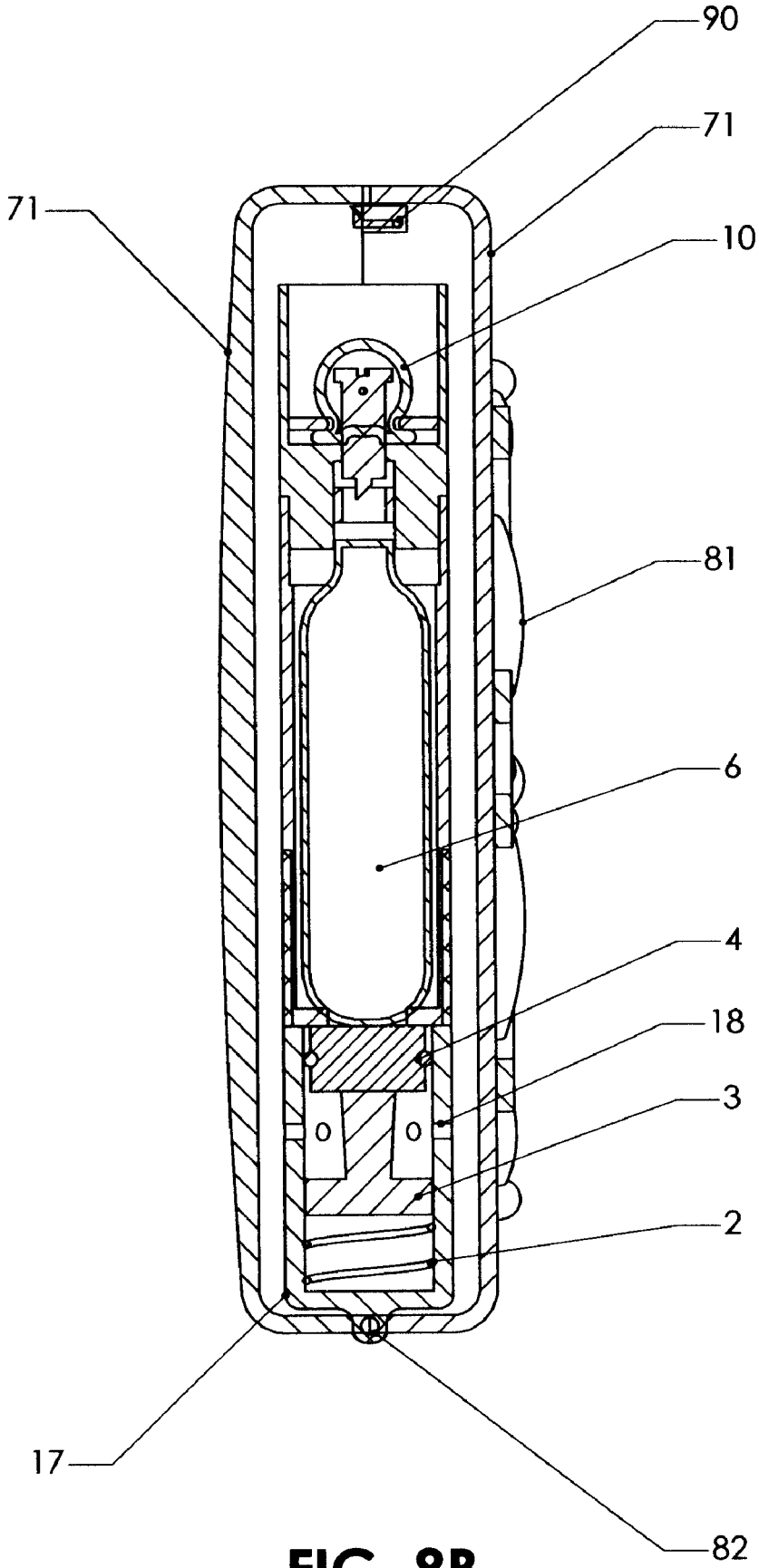
Figure 8C:
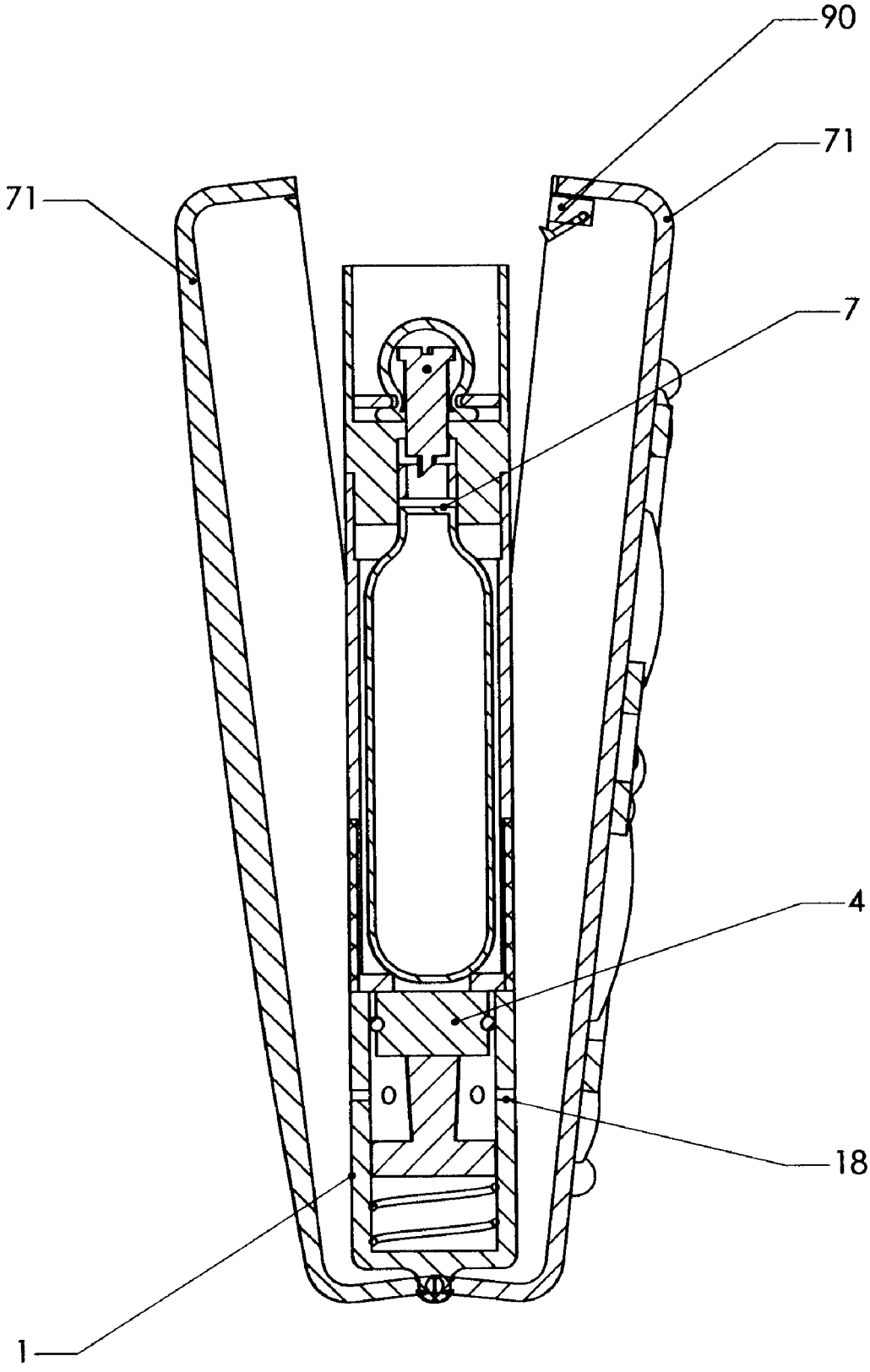
Figure 8D:
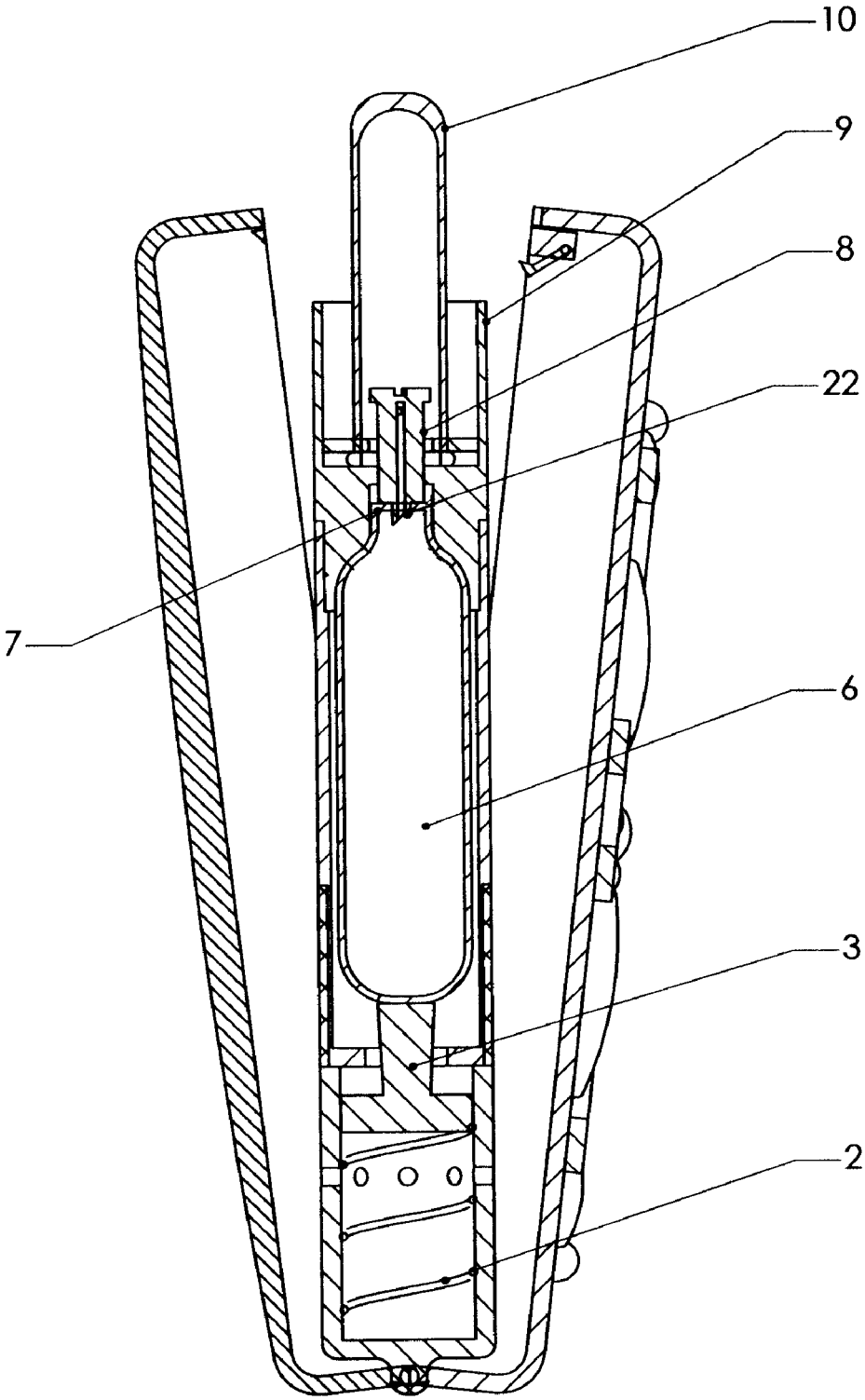

FIGS. 8A-8D are various views of how a stylish and ornamental version of the embodiment shown in FIGS. 6A-6D can work utilizing the compressed gas version of the invention. It should be noted that the substance version of the invention, illustrated in FIGS. 6A-6D could work equally well in the ornamentally designed version shown here. FIG. 8A is a stylized embodiment of the invention designed to look like a yacht's steering wheel (81). There are two mating container portions (71), connected to each other by a hinge (82). In this particular embodiment, the mating halves are not opposing sides of a cylinder, but rather a more ornamental design. As water rushes into the interior of the device through inlets (not shown in this embodiment but could be located anywhere on the device), a trigger mechanism is activated, causing the two mating container portions (71) to release from one another, thereby allowing a balloon to expand and float the device to the surface. FIG. 8B shows a cut-away view of this embodiment of the invention, where the basic compressed gas embodiment of the invention is encased in a stylized decoration (81) on the surface of one of the mating container portions (71). The other parts of the invention are similar to that described in FIGS. 1A-1D, except that rather than having an end cap release from a container, the two mating container portions (71) split apart from each other once the triggering mechanism (90) is activated. It should be noted that any of the triggering mechanisms described in this application and in U.S. patent application Ser. No. 11/447,410 would be functional in this embodiment. In FIG. 8C, water has reached and activated the triggering mechanism, thereby causing the two mating container portions (71) to fall away from each other. Water has not yet, in this figure, inundated the interior of the lower casing (1) through the inlets (18), so the bobbin (4) has not yet dissolved. In FIG. 8D, water has already dissolved the bobbin, whereupon the spring (2) pushes the plunger (3) into the bottom of the canister (6), forcing the canister against the puncture point (22) of the syringe (8), which "pops" the canister, causing compressed gas to escape the canister, which is sealed against the syringe (8) by the O-Ring (7) and flow through a hollow tube inside of the syringe (8) into a balloon (10), housed in a balloon casing (9). The balloon then expands with the gas and provides floatation to the device and whatever object the device is attached to.

It should be stressed that this embodiment would work just as well with an interior container which comprises at least one substance, which, when mixed with water creates bubbles, which would then fill a balloon.

In other embodiments, a manufacturer need only change the sizes, composition, or other basic characteristics of the invention as laid out here, to affect the desired results. For example, in the embodiment to fill holds in a submerged object or prevent the holds from filling with water, the trigger fuse is set longer, and canister is larger, and the balloon is larger and tougher. In the embodiment in which the invention is used to prevent such large objects from sinking, the trigger fuse is short but the canister is the same size and the balloon is also large and made of tough resilient material. The additional figures all illustrate different aspects of the invention in its different embodiments.

For embodiments related to participants in water-related sports such as kayaking, surfing, and SCUBA diving, the gas may be compressed air and the trigger may be set to be sensitive to water, depth, or pressure.

Other uses shall be apparent to one skilled in the art, all of which we claim as our invention.

What I claim is:

1. A device for providing buoyancy to a negatively buoyant object, comprising: a lower casing, means of maintaining pressure, a plunger, a bobbin designed and manufactured to disintegrate under a certain condition, a casing, a canister filled with a compressed gas, an O-Ring, a syringe, a balloon casing, a balloon, and an end cap, where, when the bobbin disintegrates, the means of maintaining pressure causes the canister to move up and be punctured by the syringe, whereupon the compressed air in the canister exits the canister and fills the balloon, thereby providing sufficient buoyancy for the object to float.

* * * * *